US005513922A

United States Patent [19]

Umbach

[11] Patent Number: 5,513,922

[45] Date of Patent: May 7, 1996

[54] PRINTER HAVING A REMOVABLE CONTROL PANEL

[75] Inventor: Dirk Umbach, Hattingen, Germany

[73] Assignee: Esselte Meto International GmbH, Heppenheim, Germany

[21] Appl. No.: 311,570

[22] Filed: Sep. 23, 1994

[30] Foreign Application Priority Data

Sep. 24, 1993 [DE] Germany ..... 43 32 561.0

[51] Int. Cl.[6] ..... B41J 29/16

[52] U.S. Cl. ..... 400/691; 900/694; 347/222

[58] Field of Search ..... 400/120.01, 691, 400/692, 693, 694; 403/DIG. 1; 346/145; 347/222

[56] References Cited

U.S. PATENT DOCUMENTS

| | | | |
|---|---|---|---|
| 4,492,355 | 1/1985 | Bylin | 403/DIG. 1 |
| 4,734,710 | 3/1988 | Sato et al. | 400/692 |
| 4,830,525 | 5/1989 | Nagashima et al. . | |
| 4,934,079 | 6/1990 | Hoshi . | |
| 5,209,583 | 5/1993 | Lewis et al. | 400/692 |
| 5,302,041 | 4/1994 | Fogle et al. | 400/692 |

FOREIGN PATENT DOCUMENTS

| | | | |
|---|---|---|---|
| 0363507 | 4/1990 | European Pat. Off. . | |
| 0490481 | 6/1992 | European Pat. Off. . | |
| 0526248 | 2/1993 | European Pat. Off. . | |
| 0597500 | 5/1994 | European Pat. Off. . | |
| 7813202 | 9/1978 | Germany . | |
| 8317521 | 11/1983 | Germany . | |
| 0116157 | 7/1983 | Japan | 400/692 |
| 0252181 | 11/1986 | Japan | 400/692 |
| 63-17061 | 1/1988 | Japan . | |
| 63-276582 | 11/1988 | Japan . | |
| 2210523 | 8/1990 | Japan . | |
| 2307430 | 12/1990 | Japan . | |
| 5124304 | 5/1993 | Japan . | |
| 1428614 | 10/1988 | U.S.S.R. | 403/DIG. 1 |
| 2143117 | 2/1985 | United Kingdom . | |
| 2203995 | 11/1988 | United Kingdom . | |
| 2244846 | 12/1991 | United Kingdom . | |

*Primary Examiner*—Edgar S. Burr
*Assistant Examiner*—John S. Hilten
*Attorney, Agent, or Firm*—Thomas N. Ljungman

[57] ABSTRACT

To be able to set up and operate a printer with a control panel in any position, the printer housing or similar structure of the printer contains a panel receptacle for holding a removable control panel, whereby the latter is connected to the control components of the printer by means of a cable, or at least a wireless infrared transmitter, and that the control panel is fixed at least in the direction of withdrawal in the panel receptacle by means of at least one magnet.

9 Claims, 14 Drawing Sheets

FIG. 5
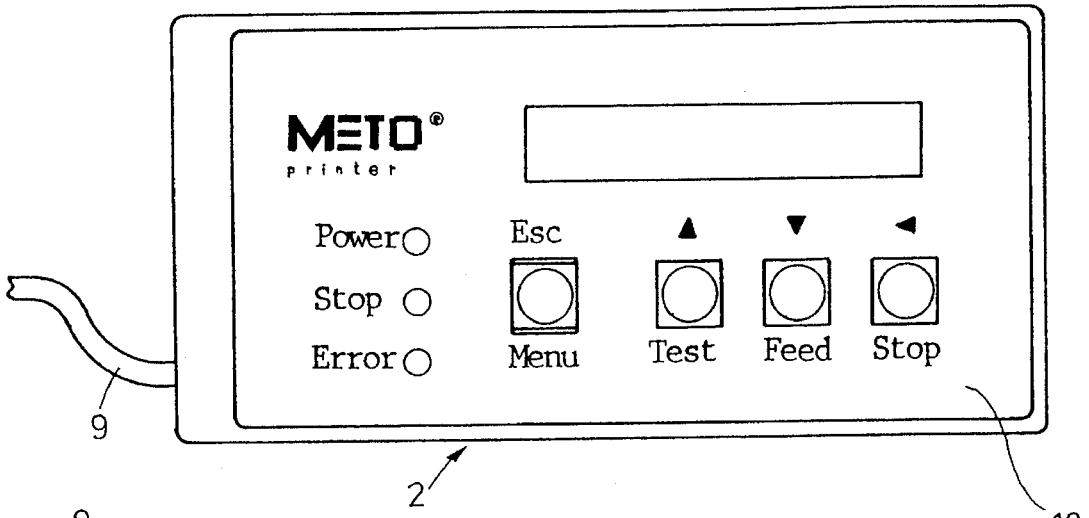
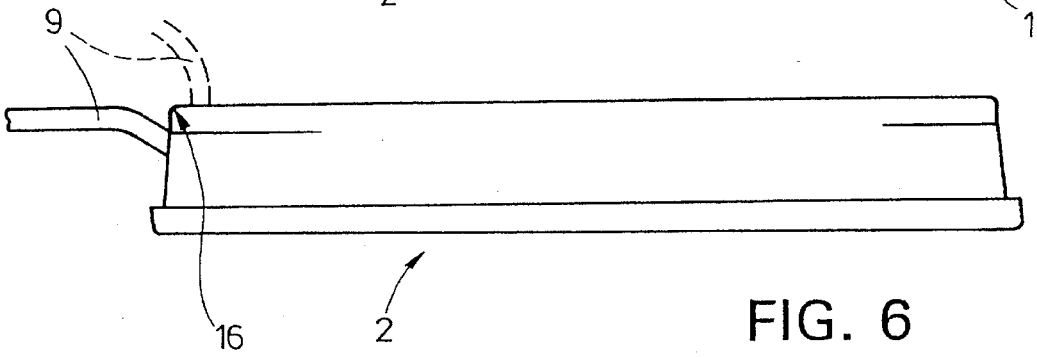
FIG. 6
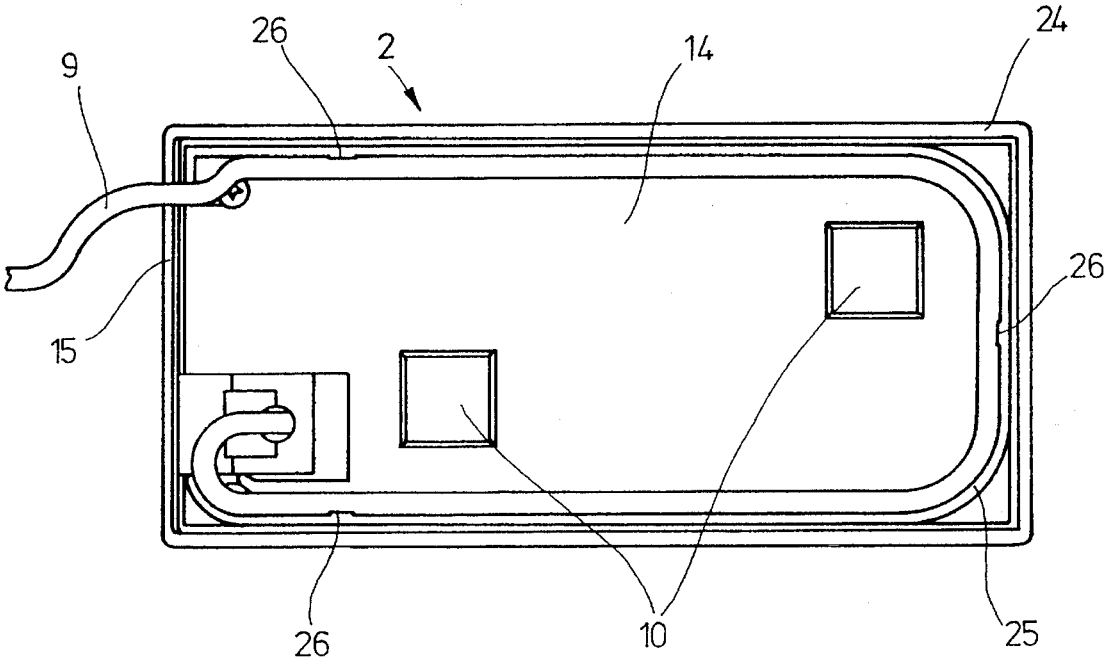
FIG. 7

FIG. 5a
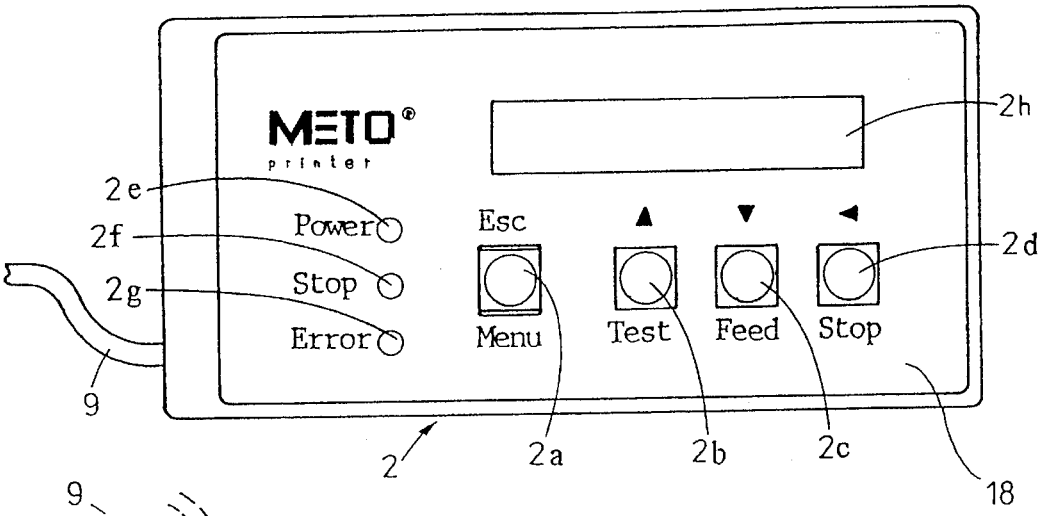
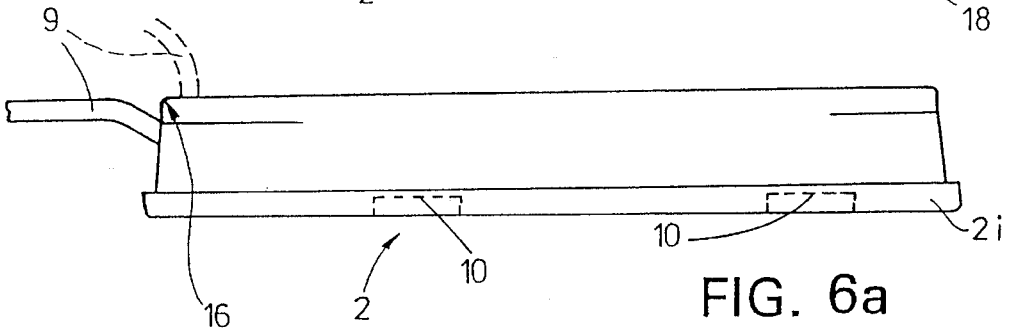
FIG. 6a
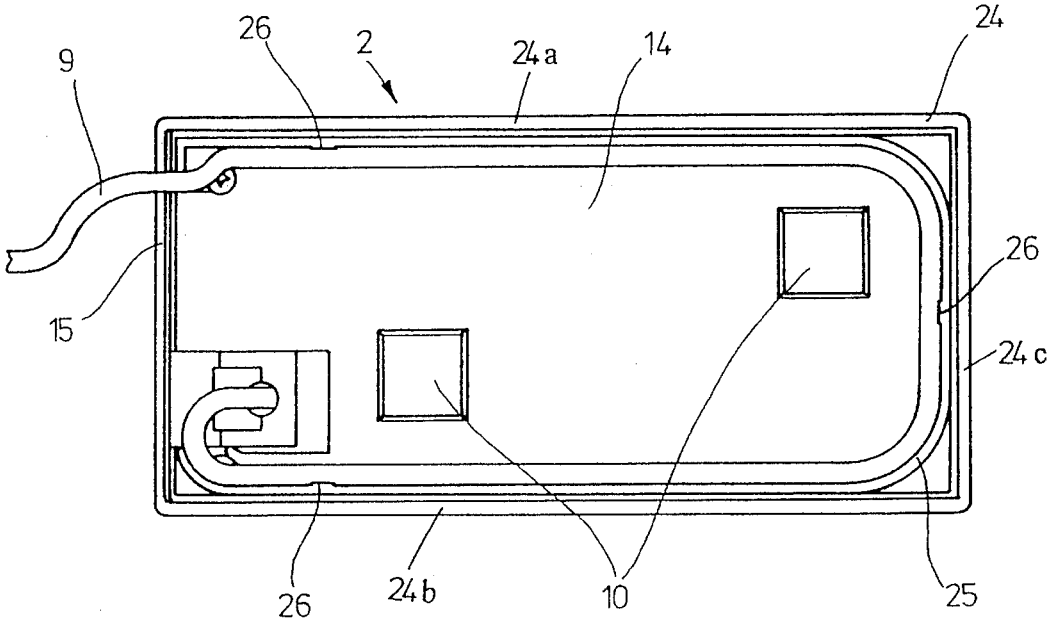
FIG. 7a

PRINTER HAVING A REMOVABLE CONTROL PANEL

BACKGROUND OF THE INVENTION

1. Field of the Invention

The present invention generally relates to a printer with a control panel, in which printer the housing or similar enclosure has a panel receptacle to hold the removable control panel, whereby the control panel is connected to the control components of the printer by means of a cable, or at least by means of a wireless infrared transmitter.

2. Background Information

Such a printer is preferably a thermal transfer printer. Thermal printers are generally very compact so that their placement on a desk, for example, typically does not pose any problems. Occasionally, however, the printer must be placed in a specific location which then makes operation of the printer difficult because the control panel is not easily accessible or visible. The poor visibility of the control panel can be a function of both the physical location of the printer and the lighting conditions, which under certain conditions can make it difficult to read the control panel display.

Japanese Patent 61-162663 discloses an electronic typewriter on which the keyboard, being connected to the typewriter by means of a cable, is located in a recess in the housing and can be removed from this recess. The inside dimensions of the recess correspond to the outside dimensions of the keyboard.

One disadvantage of such a design is that there is no mechanism to hold the keyboard in place, so that during transport, for example, the keyboard can become detached from the typewriter.

OBJECT OF THE INVENTION

The object of the present invention is therefore to design a printer with a control panel so that the control panel cannot fall out of its panel receptacle, and so that operation of the printer, by means of the control panel, is easy in many physical locations of the printer.

SUMMARY OF THE INVENTION

To achieve this object, the present invention teaches that the printer can preferably be designed with a removable control panel in which the housing, or similar structure, preferably has a panel receptacle to hold the control panel, whereby the control panel can preferably be connected to the printer by means of a cable, and that the control panel is fixed in the panel receptacle, at least in the direction of removal, by means of at least one magnet.

In accordance with the present invention, the control panel can preferably be fixed in the panel receptacle, at least in the direction of withdrawal, preferably by means of at least one magnet. When the control panel, which had previously been removed from the panel receptacle, is inserted once again into the panel receptacle, the magnetic forces engage upon reaching the limit position and hold the control panel firmly in place, at least In the direction of insertion. On the other hand, the magnetic forces are such that the control panel can be easily removed. In general, magnetic fastening devices are not only inexpensive and simple to use, but are also typically very heavy duty. Because the present invention makes it possible for the operator to remove the control panel and operate the printer from a remote location, all the buttons, etc., of the control panel are essentially always easily accessible and the display can be read easily. On the other hand, when the printer is in an optimal location, the control panel can be left in the printer and the printer can be operated in the same manner as any other printer with an integrated control panel. When the control panel is inserted within the panel receptacle, visually, the printer housing and the control panel form a unit.

When the printer is operated with the control panel removed, the data entered via the control panel can either be transmitted to the printer via an appropriate cable or, using known remote control technology, by means of at least one transmitter, which, for example, can be an infrared transmitter. In the latter case, the printer must naturally also be equipped with a corresponding receiver. Of course, other types of transmitters and receivers could be utilized in accordance with the present invention, such as a radio transmitter end a radio receiver.

A printer is most often serviced via a side wall or the back wall. In this situation, however, it is particularly advantageous if the service technician can remove the control panel and control the printer from the rear, so that he or she can simultaneously observe the functioning of the printer and the operation of the panel.

If the control panel is left in the printer, because of the flush mounting of the control penal on the printer, the outside diameters of the printer are essentially preferably unchanged from those of a printer with an integrated control panel. In addition, the visual appearance of the printer is virtually unchanged.

In accordance with one preferred embodiment of the present invention, a permanent magnet or magnets can preferably be attached to the control panel, affording the advantage that the panel can be "stuck" or fixed to virtually any a ferromagnetic surface. This feature can also be advantageous when servicing or repairs are necessary. If a suitable site for attaching the control panel is available on the side or back wall of the printer during servicing work, the panel can be placed there until the work is completed. Another possibility is the attachment of the control panel to any sort of metal rack or similar object on which the printer is supported, or to any metal object which is disposed in the vicinity of the printer. In each case, the service technician can place the control panel in a favorable and convenient location, making his or her work significantly easier and/or reducing the time required for this work.

It is also possible, of course, that the housing, a rack or similar object for the printer is made at least pertly of a ferromagnetic material, but that the panel receptacle, at least, is made of plastic. So that the control panel can be magnetically held in place in the panel receptacle in such a case, one advantageous feature of the present invention is that when plastic or aluminum panel receptacles are used, a metal insert made of a ferromagnetic material can preferably be embedded in the plastic or aluminum in those regions of the receptacle corresponding to the locations of the magnets in the control panel. These inserts can preferably be plates whose dimensions have been coordinated with the dimensions of the corresponding magnets in the control panel. These metal or iron plates can be mounted flush in the plastic portions of the receptacle, or can even be thinly covered by the plastic, as long as the magnetic adherence is not thereby adversely affected.

For a number of reasons, and for cost reasons in particular, it is of particular advantage if each permanent magnet is made of a magnetic film. Such magnetic films are commercially available, and therefore require no further explanation here. In any case, they have the advantage that they are inexpensive to install, and they can also be easily replaced with new films.

Another advantageous feature of the present invention is that the magnets can either be mounted flush on the bottom of the control panel, or can extend above the bottom of the control panel to form feet.

Yet another advantageous feature of the present invention is that the panel receptacle can preferably be a hollow box which is partly closed by the front of the inserted control panel. For reasons relating to ease of assembly, however, it is very advantageous if this panel receptacle has either a fastening edge around its circumference or at least two fastening edges or tabs which project in opposite directions. These edges or tabs include holes through which screws can be inserted, by means of which the panel receptacle can be connected to the rack or similar part of the printer. The fastening edge(s) can also be sized in such a manner that they make possible a visually favorable integration with the printer. Further, the control panel cables preferably passes through a rear cable opening of the receptacle into the interior of the printer.

Another advantageous feature of the present invention is that the control panel housing can have an essentially rectangular-shape, and can be more or less tightly closed, depending on the sensitivity of the individual components located within the housing. In any case, the housing preferably should typically have sufficient stability to withstand possible rough handling.

If wireless transmission is not used, and the printer is instead connected by cable to the control panel, the cable should preferably typically have a minimum length of about 80 to about 100 cm, for example, to take full advantage of the design in accordance with the present invention. In many cases, such as when the control panel is "stuck" onto a side wall or to the rear of the printer during servicing, a much shorter cable is also sufficient. The longer the cable, however, the more difficult it can become to replace the control panel in the panel receptacle. Thus, there can preferably be a cable trough in the peripheral region of the bottom of the control panel which preferably extends along at least three sides of the panel. The cable or a portion of its length, such as half the length of the cable, can preferably be stored in this cable trough so that, in cases where the control panel is used in the immediate vicinity of the printer, essentially only a portion of its length extends from the printer. In this manner, the cable typically does not interfere with the work being performed and the cable is also protected. Furthermore, it is particularly easy to replace the control panel when the cable has only been partly withdrawn.

Another advantageous feature of the present invention is that there can be at least one peg or retaining tab for the cable, which peg or pegs can preferably project at right angles on each of at least three segments of the cable trough. The cable can preferably be placed in the cable trough and, in the vicinity of each retaining tab, can preferably be pushed under the tab. The tab prevents the cable from falling out due to its own weight. On the other hand, if the entire length of the cable is required, the cable can easily be pulled past the retaining tabs and out of the cable trough.

If the control panel has been removed and placed in a suitable location, the cables typically must exit from the side of the housing so that the panel, can be easily fastened in place by means of the magnets. On the other hand, when the control panel is replaced in the panel receptacle, it is not particularly practical for the cable to extend out of the side. To improve this situation, the opening in the control panel for the date transmission cable can be located partly in at least one of the side walls and partly in the base. When the control panel is used externally, the cable can extend from the side of the housing, and when the control panel is replaced in the panel receptacle, the cable can then be pivoted to some extent, so that it extends from the rear of the control panel housing.

When the word "invention" is used in this specification, the word "invention" includes "inventions" that is the plural of invention. By stating "invention", the Applicant does not in any way admit that the present invention does not include more than one patentably and non-obviously distinct invention, but this application may include more than one patentably and non-obviously distinct invention. The Applicant hereby asserts that the disclosure of this application may include more than one invention, and in the event that there is more than one invention, that these inventions may be patentably and non-obvious with respect to one another.

One aspect of the invention resides broadly in a printer, such as a thermal printer for printing an image onto a printing medium, the printer comprising a housing; means for printing an image onto a printing medium; the printing means being disposed in the housing; means for moving at least one of: the printing medium and the printing means relative to the other; means for controlling the printer; the housing comprising: means for accepting the controlling means; means for transferring information at least from one of a) and b): a) the controlling means to the printer; and b) the printer to the controlling means; the controlling means having means for selectively magnetically attaching the controlling means to the accepting means and selectively magnetically detaching the controlling means from the accepting means; and the means for magnetically attaching providing an attractive force between the controlling means and the accepting means, when the controlling means and the accepting means are attached to one another, such that a substantial manual force is required to separate the controlling means from the accepting means.

Another aspect of the invention resides broadly in a printer, such as a thermal printer for printing an image onto a printing medium, the printer comprising: means for transferring information from at least one of: to and from the printer; means for receiving information from the transferring means; means for storing information from the transferring means; first means for sending the information received by the receiving means from the transferring means to the storing means; a housing; means for printing en image onto a printing medium; the printing means being disposed at the housing; second means for sending the information received from the transferring means from the storing means to the printing means; means for moving at least one of: the printing medium and the printing means relative to the other; means for controlling the printer; the housing comprising: means for accepting the controlling means; means for conveying information at least from one of a) and b): a) the controlling means to the printer; and b) the printer to the controlling means; the controlling means having means for selectively magnetically attaching the controlling means to the accepting means and selectively magnetically detaching the controlling means from the accepting means; the means for magnetically attaching providing an attractive force between the controlling means and the accepting means, when the controlling means and the accepting means are attached to one another, such that a substantial manual force is required to separate the controlling means from the accepting means; and the transferring means comprising the controlling means.

Another aspect of the invention resides broadly in a method of attaching means for controlling a printer to a printer, such as a thermal printer for printing an image onto a printing medium, the printer comprising: a housing; means for printing an image onto a printing medium; the printing means being disposed in the housing; means for mowing at least one of the printing medium and the printing means relative to the other; the housing comprising: means for accepting the controlling means; means for transferring information at least from one of a) and b): a) the controlling means to the printer; and b) the printer to the controlling means; the controlling means having means for selectively magnetically attaching the controlling means to the accepting means and selectively magnetically detaching the controlling means from the accepting means; and the means for magnetically attaching providing an attractive force between the controlling means and the accepting means, when said controlling means and said accepting means are attached to one another, such that a substantial manual force is required to separate the controlling means from the accepting means; the method comprising the steps of: providing the controlling means; providing a housing; providing the printing means; printing an image onto a printing medium with the printing means; disposing the printing means in the housing; providing the moving means; the step of providing the housing further comprises providing the accepting means; providing the means for transferring information; the step of providing the controlling means further comprises: providing means for selectively magnetically attaching the controlling means to the accepting means and selectively magnetically detaching the controlling means from the accepting means; the method further comprising the steps of attracting the controlling means to the accepting means and the accepting means to the controlling means, with the means for magnetically attaching; selectively magnetically attaching the controlling means to the accepting means with the means for magnetically attaching; and applying a substantial manual force to detach the controlling means from the accepting means.

BRIEF DESCRIPTION OF THE DRAWINGS

Additional advantages, characteristics and details of the present invention are explained in greater detail below with reference to the accompanying drawings, in which:

FIG. 5 is a top view of the removed control panel;

FIG. 5*a* shows substantially the same view as FIG. 5, but shows additional components;

FIG. 6 is a side view of the control panel;

FIG. 6*a* shows substantially the same view as FIG. 6, but shows additional components;

FIG. 7 is a view of the back of the control panel as shown in FIGS. 5 and 6;

FIG. 7*a* shows substantially the same view as FIG. 7, but shows additional components;

DESCRIPTION OF THE PREFERRED EMBODIMENT

Figure 1:
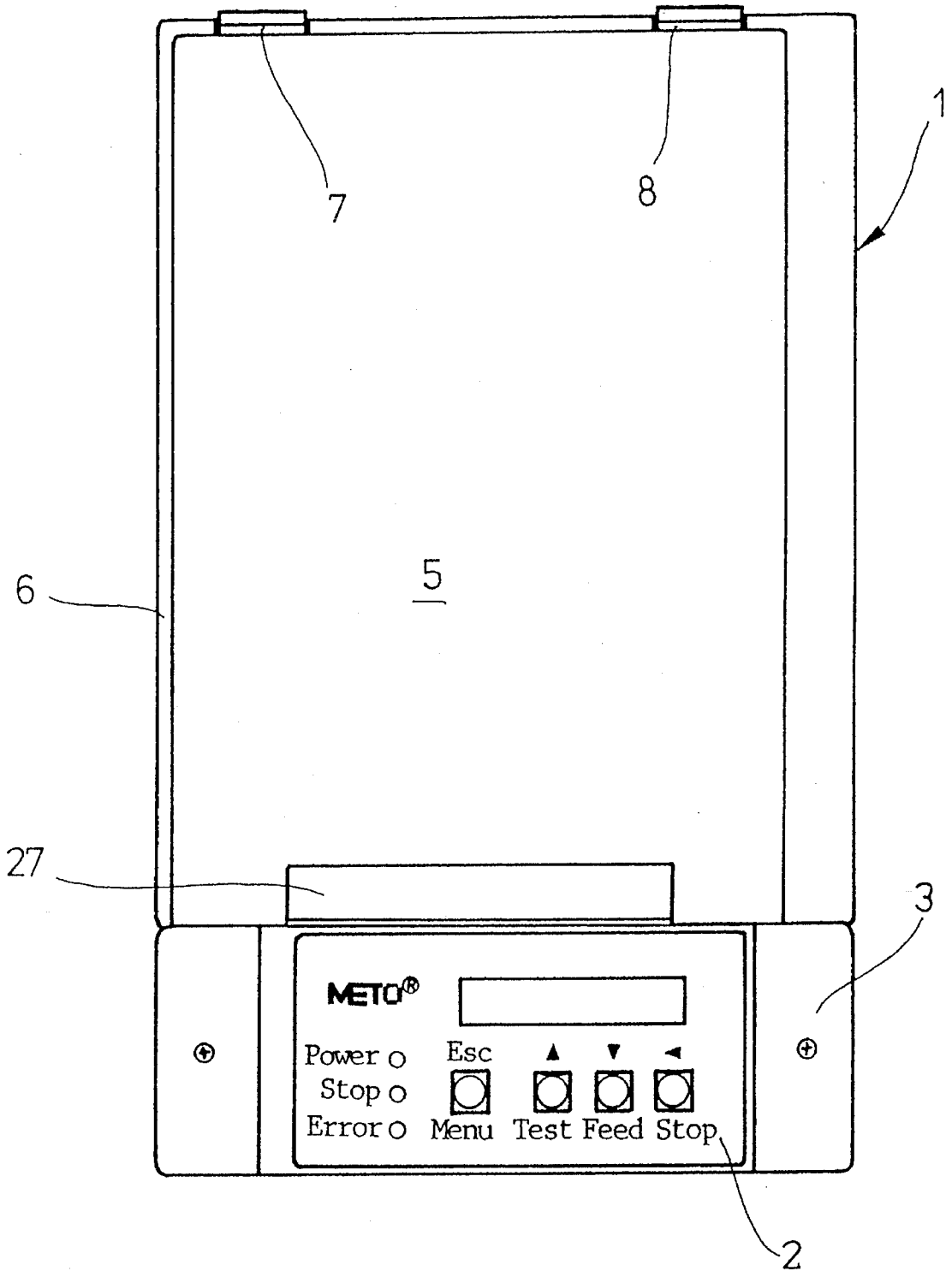
FIG. 1 shows a front view of a printer with the control panel inserted.
Figure 2:
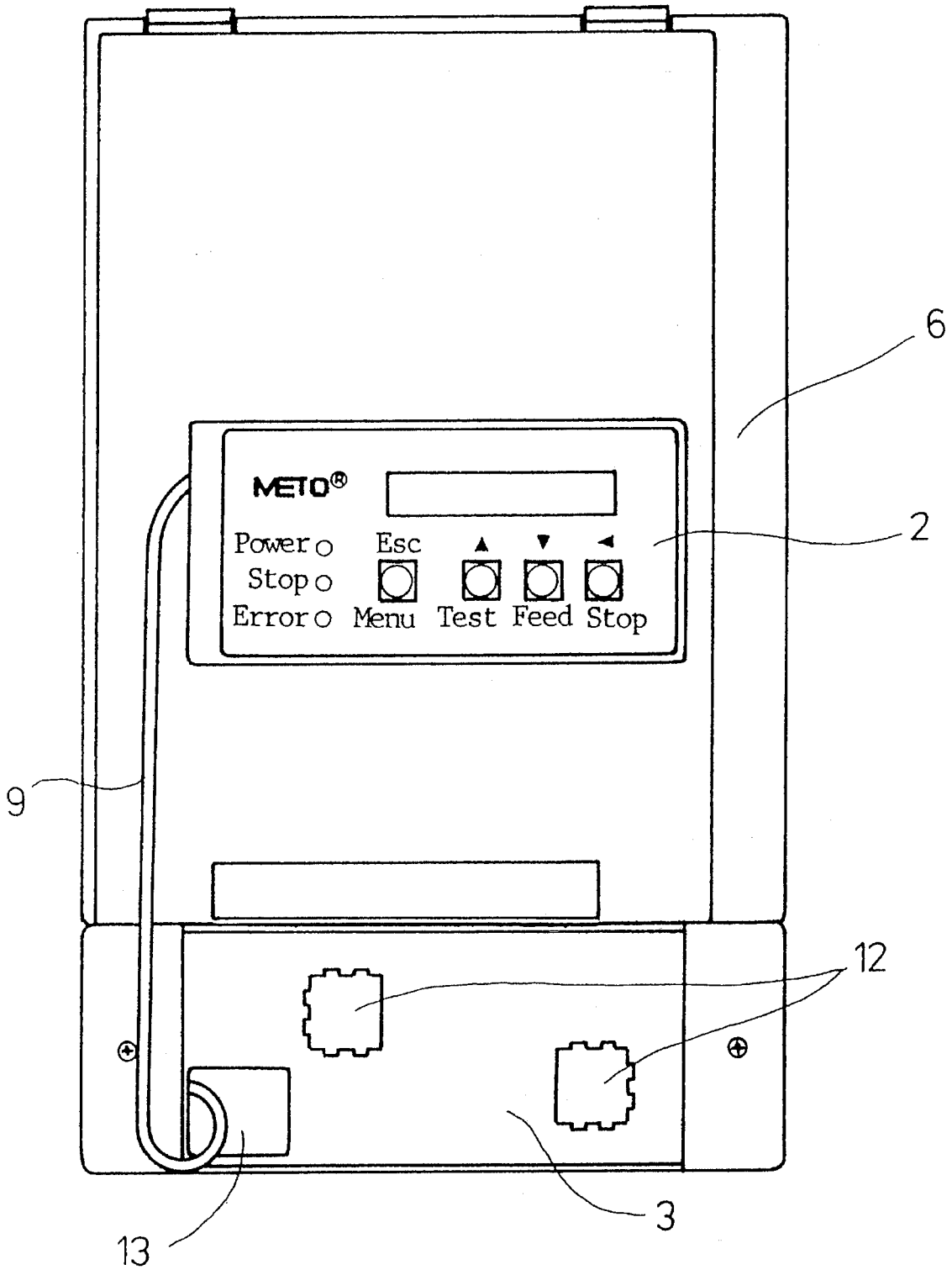
FIG. 2 is a corresponding view with the control panel removed and attached to the front wall.
Figure 4:
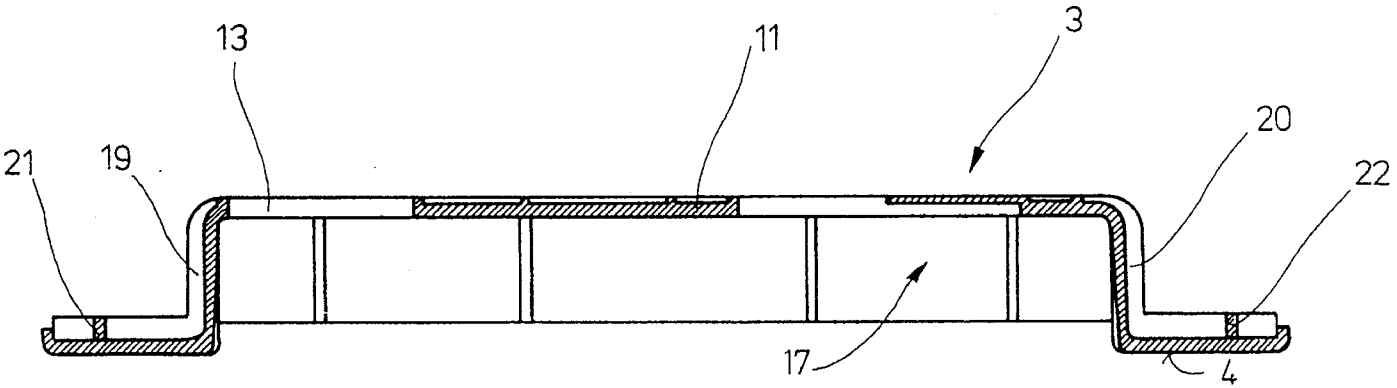
FIG. 4 is a cross-section along Line IV—IV in FIG. 3.

The printer 1 in FIGS. 1 and 2 can preferably be a thermal transfer printer. The printer 1 preferably has a relatively compact, essentially rectangular housing 6. At the lower end of the housing 6, in accordance with one embodiment of the present invention, there can preferably be a control panel 2 which, during transportation and many applications of the printer, can be located in a panel receptacle 3. The control panel 2 can be inserted into the panel receptacle 3, and preferably does not project beyond the forwardmost surface 4 (FIG. 4) of the panel receptacle 3 but can preferably be essentially flush with the surface 4. At the same time, the orientation of the panel 2 can also preferably be flush with the front surface 5 of the housing 6 of the printer 1.

As shown in FIG. 1, the largest portion of the front surface 5 of the printer 1 can preferably be configured as a folding cover which can be swung up around upper bearings 7 and 8. In accordance with one embodiment of the present invention, upper bearings 7, 8 can preferably be hinges. Of course, other suitable fastening and/or pivoting arrangements could be utilized.

Figure 1A:
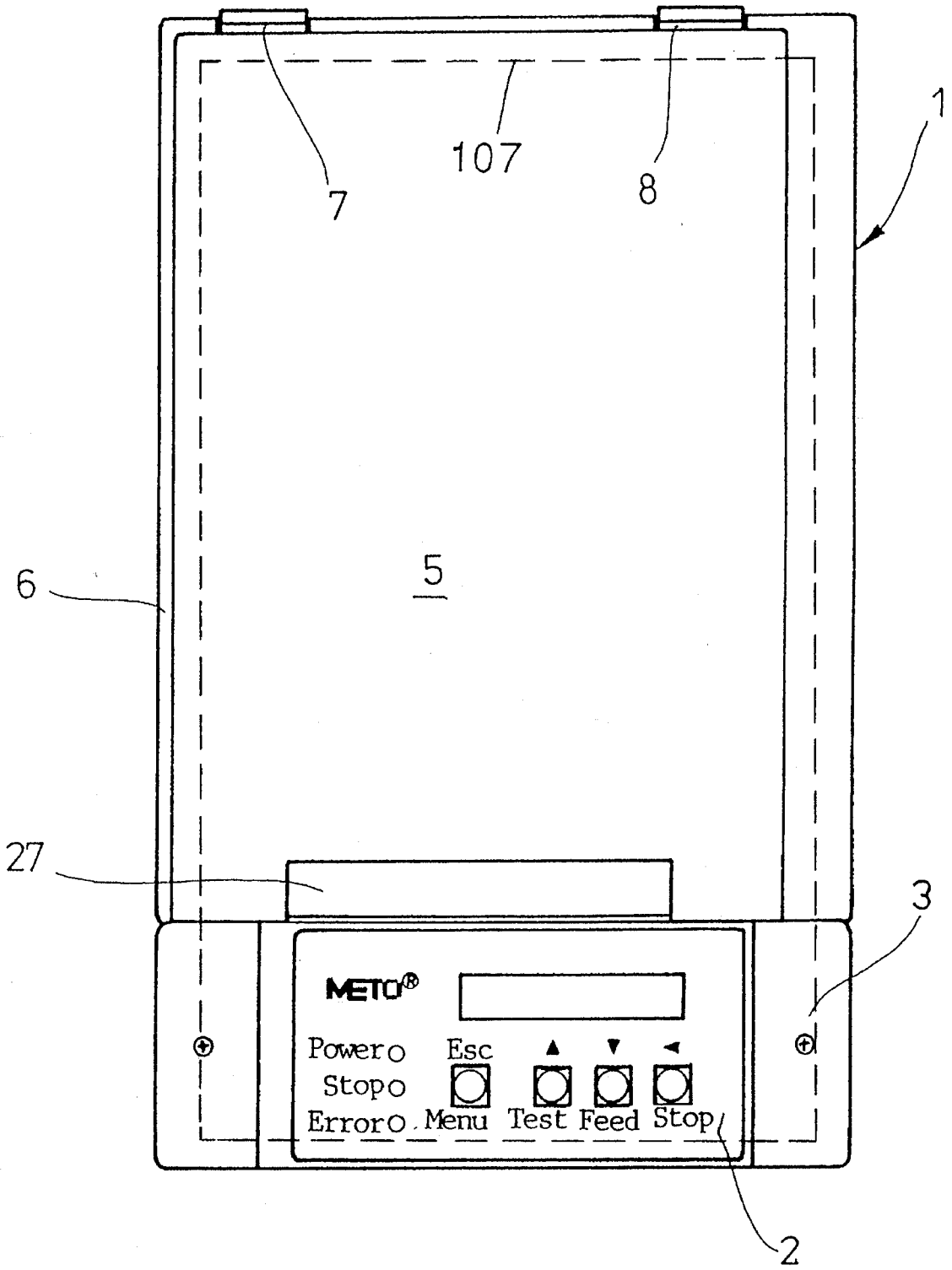
FIG. 1*a* shows substantially the same view as FIG. 1, but shows additional components.

FIG. 1*a* shows one embodiment of the present invention in which the internal components of the thermal printer are represented schematically by the reference numeral 101. The internal components 101 of the thermal printer are illustrated in more detail in FIG. 8, discussed further herebelow.

As shown in FIG. 5, the front or control side of the control panel 2 preferably contains control elements 2*a*, 2*b*, 2*c* and 2d (see FIG. 5a), indicator elements 2e, 2f, and 2g (see FIG. 5a) and a display 2h (see FIG. 5a), for example. The precise configuration of the control panel 2 can preferably be a function of the requirements and capabilities of the printer 1, thus, many variations of the above are possible.

With the control panel 2 removed from the printer 1 or the panel receptacle 3, the commands input at the panel can be transmitted either wirelessly, such as by means of infrared waves, or, as with the embodiment in question, preferably by means of a cable 9 to the appropriate control and switching devices of the printer 1. In accordance with the present invention, it makes essentially no difference which transmission method is used.

There can preferably be at least one but, as shown in FIG. 7, preferably two permanent magnets 10 on the back side of the control panel 2. The permanent magnets 10 preferably ensure a secure retention of the control panel 2 in the panel receptacle 3, and thus on the printer 1. However, if the panel receptacle 3, or a portion thereof, is made of plastic or at least of a non-ferromagnetic material, in accordance with at least one embodiment of the present invention, two metal inserts 12 (FIG. 2) can preferably ensure that the control panel 2 is fastened to the base 11 of the panel receptacle 3. The inserts 12 can preferably be placed in positions corresponding to the position of the permanent magnets 10 in or on control panel 2. The inserts 12 can preferably be mounted flush with the base 11 (FIG. 3) or they can project from the base 11, if desired. The above-mentioned retention of the control panel 2 by the permanent magnets 10 is at least essentially limited to the direction in which the control panel 2 is removed, that is, a direction perpendicular to the plane of the drawing. Otherwise, the control panel 2 can preferably fit more or less tightly into the panel receptacle 3, so that essentially no additional holding or retention against lateral movements is required. Also located on the base 11 of the panel receptacle 3 preferably is a cable bushing 13 through which the cable 9 can pass into the printer 1.

As can be seen in FIG. 6, the permanent magnets 10 can preferably be mounted essentially flush in the base 14 of the control panel 2. However, the permanent magnets 10 can also project from the base 14, thus forming magnetic feet. In this case, it would then be appropriate to select another configuration, such as shown in FIG. 7. One such permanent magnet 10 can preferably be placed at each corner, for example. In the illustrated embodiment, each permanent magnet 10 can preferably comprise a magnetic film. Such magnetic films are known and will not be discussed further herein.

In accordance with an alternative embodiment of the present invention, instead of the permanent magnets 10 being used to secure the control panel 2 in the receptacle 3, other types of fastening devices could conceivably be utilized. For example, velcro fasteners could be placed on the back of the control panel 2 and also on various locations of the printer, and also in various locations around the printer. Thus, the control panel 2 could be fastened to these various locations by means of the velcro strips. Alternatively, double-backed adhesive material could be placed in various positions on the back of the control panel 2, and the control panel 2 could then be stuck in a number of locations. Alternatively, if a certain position of the control panel 2 is often used, several relatively short screws could be placed in the back of the control panel 2 and brackets with slots for the screw heads could be mounted at this particular position, so that the control panel 2 could be temporarily mounted at this position.

FIG. 6 also shows that the essentially rectangular housing 24 of the control panel 2, which can have on the control side one edge 2i (see FIG. 6a), which edge 2i can preferably project laterally. The housing 24 of the control panel 2 can be designed, preferably in the region where the cable 9 exits, so that when the control panel 2 is externally fastened, or removed from the panel receptacle 3, the cable 9 can exit from the wall 15 or, as indicated by the dotted line (FIG. 6), can exit toward the rear from the back of the housing 24. There can preferably be a slot in the housing 24 which extends around a corner 16 of the housing 24 which preferably permits the cable 9 to exit from the back of the housing 24.

The length and width of the control panel housing 24 can preferably correspond with the usual clearance to the clearance width of the cavity 17 of the panel receptacle 3, measured in the transverse and longitudinal directions. In other words, the control panel housing 24 can preferably have a length and a width which substantially correspond to the length and width of the cavity 17 (see FIG. 4) of panel receptacle 3. Further, the thickness of the control panel 2 is such that its front surface 18 (FIG. 5) does not project beyond the forwardmost surface 4 of the panel receptacle 3, but is instead essentially flush with the surface 4. Thus, the required space is essentially exactly the same as for a printer 1 with a non-removable, or integrated, control panel 2.

In accordance with one preferred embodiment of the present invention, there can preferably be fastening edges 21 and 22, which fastening edges 21 and 22 can extend at approximately right angles on two opposite walls of the housing, or more precisely on the transverse housing walls 19 and 20 respectively. As shown in FIG. 1, the panel receptacle 3 can thus have e width which essentially corresponds to, or possibly is less than, the width of the housing 6 of the printer 1. There can also be a hole 23 in each fastening edge 21 and 22, through which hole 23 the panel receptacle 3 can preferably be bolted to the housing 6 or rack of the printer 1.

FIG. 7 shows that there can preferably be a cable trough 25 located on the outside of the base 14 of the essentially rectangular housing 24 of the control panel 2. In accordance with this embodiment, the cable trough 25 can extend at least along the two longitudinal sides 24a and 24b (see FIG. 7a) and the transverse side 24c (see FIG. 7a) opposite the cable exit point. The cable trough 25 can hold approximately half the length of the cable 9. So that the cable 9 cannot fall out of the cable trough 25, there can preferably be at, least one retaining tab 26, in particular a molded tab, which tab 26 preferably projects at right angles over each of the three segments of the cable trough 25. At the respective points, the cable 9 can be pressed elastically underneath the tab 26. However, if the entire length of the cable 9 is needed, it can easily be withdrawn from under the retaining tabs 26.

Figure 3:
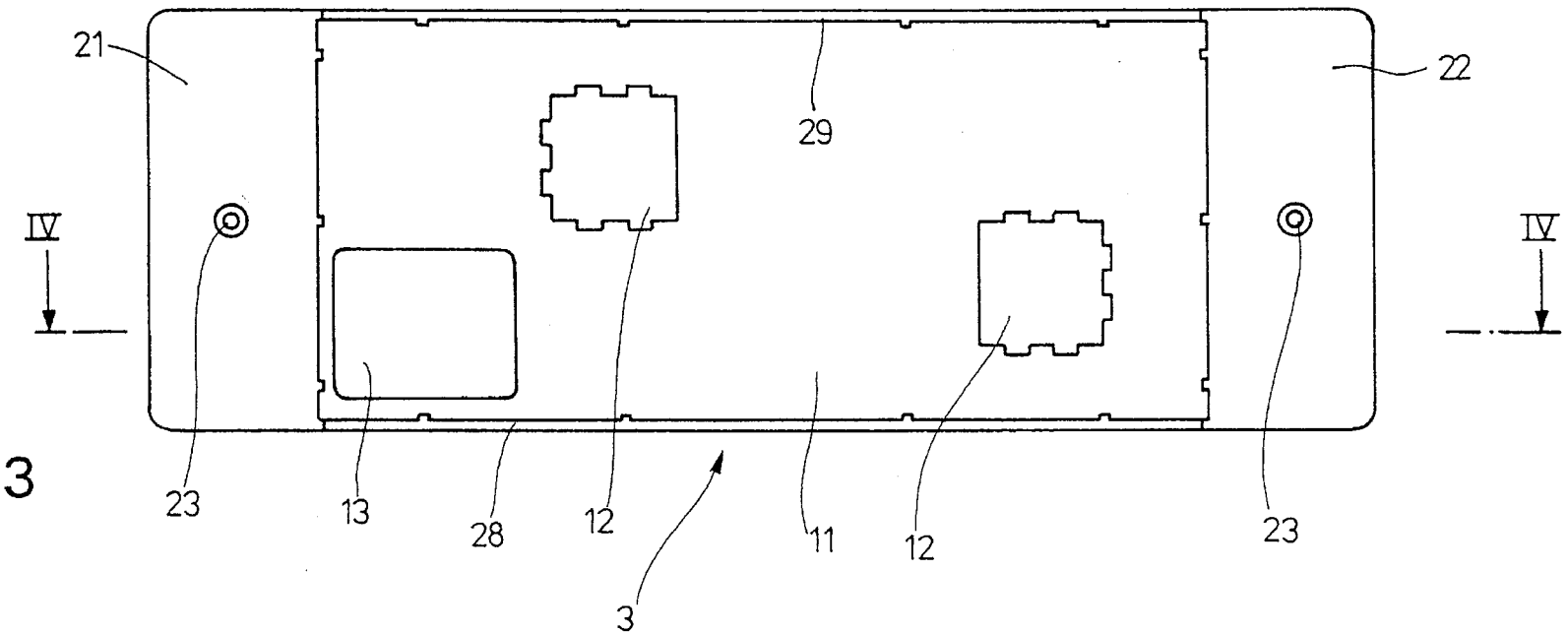
FIG. 3 is an enlarged view of the panel receptacle shown in FIG. 2.

As mentioned above, the front surface 5 of the housing 6 of the printer 1 can include a cover which can be pivoted around an upper horizontal axis, preferably by means of bearings 7 and 8. The cover can preferably close so that it is essentially externally flush with the remaining stationary front surface 5. There can preferably be a grip hole or slot 27 (FIG. 1), or a recessed grip, so that this cover can be lifted. Because, as shown in FIG. 3, the longitudinal side walls 28 and 29 of the panel receptacle 3 preferably are shorter than the transverse walls 19 and 20 of panel receptacle 3, this grip hole 27 can be used to grasp the top of the control panel 2. Essentially the same arrangement can also be employed on the bottom. In this manner, the control panel 2 can be grasped and removed from the housing 6 of the printer 1, if necessary. Shorter longitudinal side walls 28 and 29 can also be used to facilitate reinsertion of the control panel 2.

Alternatively, in a manner not illustrated here, folding or retractable handles can be mounted on the front face or front surface 18 of the control panel 2 and used to remove or reinsert the control panel 2. Another possibility for removing the control panel 2 from the panel receptacle 3 can be provided by installing the control panel 2 so that it tilts slightly in the panel receptacle 3, so that the hold of the magnets 10 can preferably be neutralized, e.g. by pushing on the bottom portion of the panel 2, and the control panel 2 can then be removed in the tilted position.

FIGS. 8, 9, 10, 11, and 12 show various types of printers in which the present invention may be incorporated. It should be understood that the printers illustrated in FIGS. 8–12 are presented only by way of example, and that various components shown in FIGS. 8–12 may be interchangeable with similar components shown in FIGS. 1–7*a*.

Figure 8:
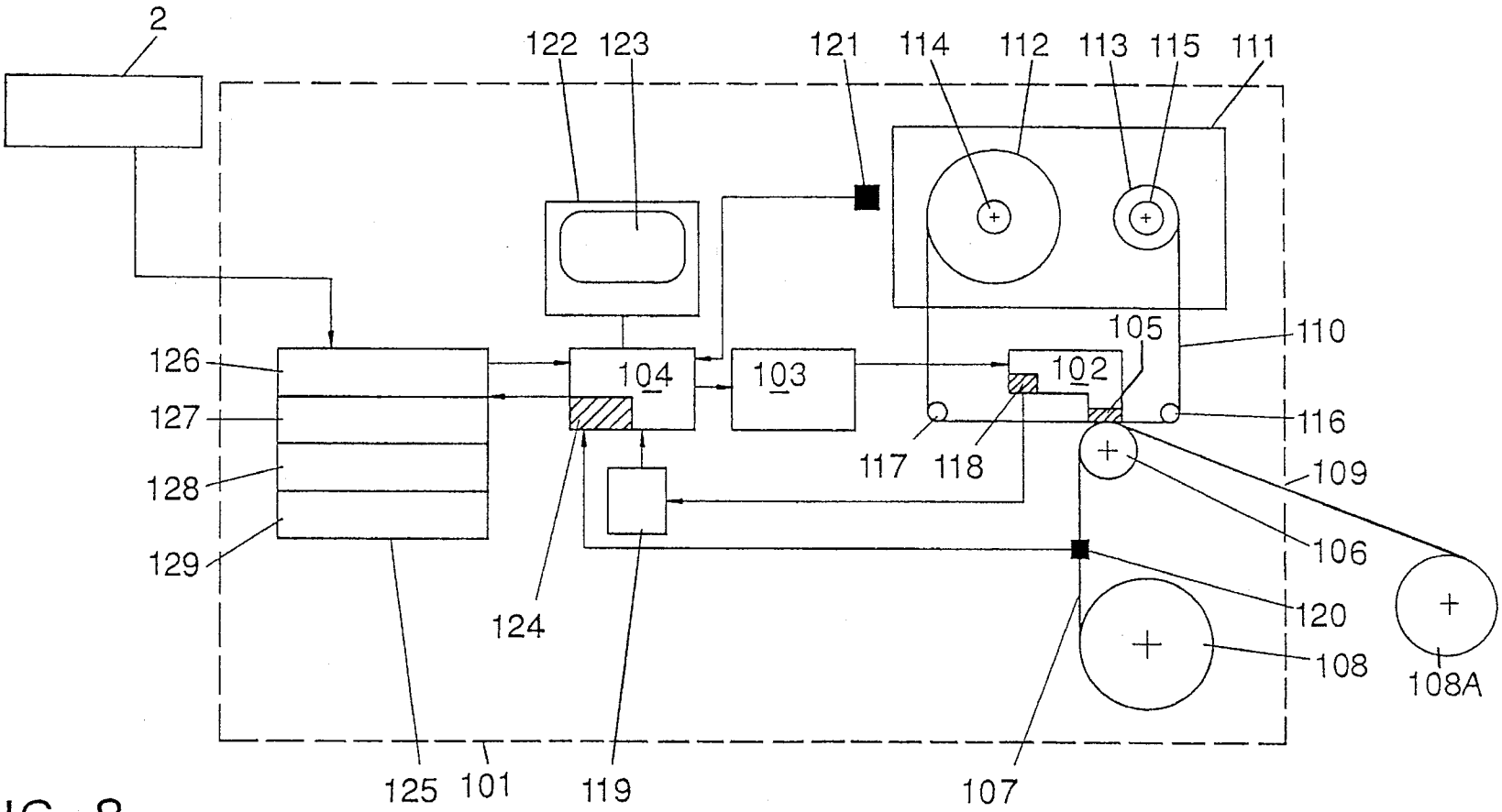
FIG. 8 shows a general embodiment of a thermal printer.

FIG. 8 shows a schematic representation of one embodiment of a thermal printer with internal components 101 (FIG. 1*a*), in which schematic representation the present invention has been incorporated. FIG. 8 also shows the control panel 2 schematically, and removed from the receptacle 3. The thermal printer shown in FIG. 8 can have a thermal print head 102 which can be electrically connected by means of a control circuit 103 to a computer processor 104. On the underside of the thermal print head 102 there can preferably be electrically activated heating elements 105, which can be maintained in contact against a counterpressure roller 106. The thermal printer illustrated in FIG. 8 can be used for printing labels, or a paper medium. If labels are to be printed, a label strip 107 can be introduced between the heating elements 105 and the counterpressure roller 106. As the label strip 107 is printed, it is preferably unrolled by means of a label strip payoff reel 108, and can, if desired, be taken up by a take up reel 108A. After having been printed with the desired printing information, the label strip 107 can be output by means of an outlet opening 109 of the thermal printer.

The label strip 107 can include a temperature-sensitive paper which is printed as it is moved past the heating elements 105. Appropriate ones of the heating elements 105 can be heated as necessary, and the areas of the paper, or label strip 107, to which heat is applied can thereby be darkened at the desired points. Alternatively, the label strip 107 can also be conventional writing paper. With such conventional writing paper, it is generally necessary to introduce a thermal transfer ink ribbon 110 between the label strip 107 and the heating elements 105 of the thermal print head 102. The thermal transfer ink ribbon 110 can essentially be coated with temperature sensitive ink, which can preferably be configured to melt at the points where it is moved past activated, or heated, heating elements 105. The melted ink then can adhere to the conventional label strip 107 to thereby form a desired printed image.

Such a thermal transfer ink ribbon 110 can preferably be housed in a cassette 111, which cassette 111 can preferably have a payoff reel 112 and a take-up reel 113 therein. The cassette 111 can generally be positioned within the thermal printer by means of devices 114, 115 which are configured to fit into, or hold the reels 112, 113. The thermal printer can also preferably have deflector rollers 116, and 117 disposed within the printer housing, to direct the path of the ink transfer ribbon past the print head 102 and heating elements 105. Such deflector rollers 116, 117 essentially make certain that the thermal transfer ink ribbon 110 is moved past the heating elements 105 at the optimum angle for transferring the ink to the paper, or label strip 107, in which the ribbon 110 is in contact at the print head 102. Such thermal transfer ink ribbons, and the manner of transferring the ink thereon, are also considered to be well known in the art. One type of cassette which could be used in conjunction with the present invention is discussed further herebelow with reference to FIGS. 12–24.

The thermal print head 102 can be equipped with a temperature sensor 118, to transmit an analog electrical signal corresponding to the temperature of the thermal print head 102 to an analog-digital (A-D) converter 119. This A-D converter can then digitize the temperature signal and transmit the digitized signal to the processor 104.

The processor 104 can also preferably be connected to a paper sensor 120, which can be, for example, a photoelectric cell which detects the presence of a label strip 107, and reports the presence or absence of a strip to the processor 104. Alternatively, the paper sensor 120 can also be configured as a laser scanner which is capable of reading bar codes. If such a scanner were to be used, bar code markings, indicative of the type of paper being used, could be provided on the paper strips. The bar code markings on the label strip 107 could then be automatically read by the scanner to provide the processor 104 with information not only about the presence of the label strip material, but also about the type of label strip material present. These data can be retrieved by the processor 104 for further processing.

The processor 104 can also preferably be electrically connected to an ink ribbon sensor 121. This ink ribbon sensor 121 can be designed either as a photoelectric cell, only to detect the presence of the thermal transfer ink ribbon 110, or, as discussed above for the paper sensor, can be designed as a laser scanner which can read the bar codes applied to the cassette 111, to thereby provide information on the material, or type of thermal transfer ink ribbon 110 being used. Photoelectric cells end laser scanners are essentially well known, and are therefore not described in any further detail herein.

Other types of sensors or scanners, within the skill of the artisan could also be used for detecting the paper or ink ribbon, or alternately scanning information provided on the paper or ink ribbon.

In order to make the thermal printer more "user-friendly", the processor 104 can preferably be connected to an optical data output medium 122. Such an output device 122 could provide an LCD screen 123 for displaying variables which the operator may have to adjust, or to alternately display control commands for operation of the printer. Alternatively, the optical data output medium 122 could be omitted and these functions of the optical data output medium 122 described above could be incorporated into the control panel 2. Various alternative output devices would also be within the skill of the artisan.

The processor 104 can also preferably be equipped with a working memory 124, the capacity of which is preferably sufficient to buffer the control data supplied both by a reed/write memory 125 connected to the processor 104, and also by the paper sensor 120 and by the ink ribbon sensor 121 during a printing process. The processor 104 can preferably use this information to control the thermal printer. With such a buffer, or working memory 124, the processor could essentially operate at higher speeds as data transfer between the read/write memory 125 and the processor 104 would not need to continuously take place.

The read/write memory 125 can essentially be partitioned into several areas depending on the features of the thermal printer. The example shown in FIG. 8 essentially depicts four memory areas 126 to 129, but more or less could be provided, with the possibility for future expansion as needed. The memory areas could be set up as provided below, but the following is meant as an example only, and various other set-ups would be well within the skill of the artisan.

A first memory area 126, could be used to store the information which is to be applied, or printed on the labels. A second memory area 127 could be used to store a data matrix corresponding to the various types of paper which are usable for the label strips 107. A third memory 128 could be used to store the printing speed, that can be set or selected by the operator, and a fourth memory area 129 could be used to store the ink ribbon data corresponding to the various types of paper of the specified label strip 107.

The number of data matrices stored in the second memory area 127 should preferably correspond to the number of types of paper of the label strips 107 which are specified for use on the particular printer. Each of these data matrices is indicative of the type of paper it describes, and can, for example, consist of an array of three rows of data, whereby the data in the first row could indicate the thermal print head temperatures, the data in the second row could indicate the printing speeds, and the data in the third row could indicate reference energy values. During printing, these reference energy values can be transmitted by the processor 104 preferably directly to the control circuit 103 to control the thermal energies to be generated by the thermal print head 102 in each of the individual heating elements 105 to thereby produce an optimized print. For each data pair consisting of a thermal print head temperature end a printing speed, there is preferably a corresponding reference energy value for the paper being printed upon. Thus, when a temperature and a speed value are input, a reference energy value can clearly be determined end output.

The ink ribbon data contained in the fourth memory area 129 could essentially be described as a list consisting of three rows. The data in the first row could indicate the type of paper of the label strip 107 to be used. The data in the second row could have the values 0 and 1, whereby a "0" can mean that when the type of paper listed in the first row is being used for printing, no thermal transfer ink ribbon is necessary, and a "1" could indicate that an ink ribbon is necessary for printing. In the third row, there can either be a "0", which can indicate that when a particular type of paper is used, no special requirements need to be set for the material of the thermal transfer ink ribbon 110, or another digit, i.e., 1, 2, 3, etc. could indicate which type of ink ribbon must be used to print the specific type of paper.

The above described data arrays can preferably be read into the read/write memory 125 by means of a data input device, such as control panel 2. Other types of input devices are possible however, such as a computer keyboard and a card reader device, or in essence any type of input mechanisms which are commonly used for entering data values into computers, i.e. a scanner.

During the installation of the thermal printer, the data matrices corresponding to the types of paper to be used can be read into the corresponding memory area, or in this example, the second memory area 127. Likewise, the ink ribbon data can be read into its corresponding memory area, or the fourth memory area 129 of the read/write memory 125. Then, when printing is to be done, the data to be printed on the label strip 107 can be input into its corresponding memory area, or the first memory area 126 by means of the control panel 2.

The processor 104, via the LCD screen 123, can then preferably output a list of the types of paper that were read into the second memory area 127. The operator can then manually select the data matrix corresponding to the type of paper to be used. Further, the printer may also be set up so that the operator is given an opportunity to verify whether there is a data matrix already stored for the particular type of paper of the label strip 107. Thus, if necessary, the appropriate data matrix can then be read into the corresponding memory area, or second memory area 127 of the read/write memory 125. Alternatively, a label strip 107 of a paper with a data matrix already stored in the memory and displayed on the LCD screen 123 can be introduced into the thermal printer.

The processor 104 can then retrieve the data matrix corresponding to the type of paper selected, and can call up the corresponding ink ribbon data from the read/write memory 125, and store these data in its working memory 124.

By means of the LCD screen 123, the processor 104 can output a list of the possible printing speeds contained in the data matrix, and thus enable the operator to select a desired printing speed. If the operator does not select a speed, the processor can automatically default to a predetermined printer speed, which can be, for example, the maximum possible printing speed of the printer. Alternately, if it is known that operation at the maximum speed is not desired, alternative default speeds, such as 50% or 75% of the maximum speed could be entered as the default speed if so desired.

The above described thermal printer thereby provides an opportunity at the beginning of the printing process to select a printing speed, which printing speed can then be stored in the third memory area 128 of the read/write memory 125. After the selected data matrix has been read into the working memory 124, the processor 104 can preferably retrieve the value corresponding to the desired printing speed from the third memory area 128, and compare this value to the speed values contained in the data matrix. The processor 104 can then preferably automatically select the value from the data matrix which either corresponds to, or is closest to the selected printing speed.

By means of the temperature sensor 118, the processor 104 can measure the temperature of the thermal print head 102 and then select, from the data matrix, the temperature value corresponding to, or closest to this value.

From the data matrix, and using the above-chosen temperature and speed values, the processor 104 can then preferably select the reference energy value which is specified for the measured value of the thermal print head temperature and the selected or specified printing speed.

In addition to the above-determinations, the processor can also proceed with determining whether or not an ink ribbon is needed, or what type of ribbon is needed. On the basis of the ink ribbon data read into the working memory 124 and specific to the type of paper, and on the basis of the data supplied by the ink ribbon sensor 121, the processor 104 can then check for the following conditions:

A) whether there is a "1" in the second row of the ink ribbon data (indicating that an ink ribbon is needed), and whether a cassette 111 for the thermal transfer ink ribbon 110 has been inserted; or B) whether there is a "0" in this position and no cassette 111 has been inserted.

If the requirements indicated above are not fulfilled, the processor can be set up to indicate such to the operator by means of an error message, either a visible, or audible warning. The error message could also contain information as to how to correct the problem, for example, either to remove the wrong cassette 111 which has been inserted, or to insert the missing cassette 111.

The processor 104 can also check to see whether there is a "0" in the third row of the ink ribbon data list, or possibly another digit identifying a thermal transfer ink ribbon 110. On the basis of this value and the values supplied by the ink ribbon sensor 121, the processor 104 can check, if necessary, to see whether the correct thermal transfer ink ribbon 110 has been inserted. By means of an error message displayed on the LCD screen 123, or possibly by an audible warning, the operator can preferably be requested to insert the correct thermal transfer ink ribbon 110 into the printer, if necessary.

Also, on the basis of the data supplied by the paper sensor 120, the processor 104 can preferably check to see whether a label strip 107 has been inserted. A warning signal can also be generated if a paper strip is not present, indicating to the operator that paper needs to be inserted.

The processor 104 can then retrieve the printing information read into the first memory area 126 of the read/write memory 125, and initiate the printing process. To initiate the printing process, the processor 104 will essentially transmit the printing information, the selected or specified printing speed, and the reference energy value selected from the data matrix to the control circuit 103 of the thermal print head 102. The control circuit 103, by means of electrical connections and driver circuits (not shown, but commonly known in the art), can then drive the counterpressure roller 106 to transport the label strip 107, as well as the thermal transfer ink ribbon 110, preferably by means of electric motors, not shown in the figure. The motor for driving the ink ribbon 110 would preferably be connected to the take-up reel 113. The control circuit 103 can also preferably start the printing process itself by activating the individual heating elements 105 as a function of the input and measured data.

In addition, the control circuit 103 could also control operation of a drive mechanism 26' discussed further below with respect to FIGS. 9 and 10, to thereby control a stopping device 14' and lift the print head 102 from the counterpressure roller 8', 106.

The reference energy value determined from the printing speed and the thermal print head temperature essentially then controls the thermal energy generated by the heating elements 105. The thermal energy generated would preferably be greater, the higher the printing speed set, and the lower the measured thermal print head temperature. Preferably, the thermal energy can be controlled by changing the times at which a specified voltage is applied to the heating elements 105. Such heating elements 105 are preferably designed as resistance heating elements.

If the paper sensor 120 is configured as a laser scanner capable of reading bar codes, and if markings are applied to the labels in the form of bar codes which provide information on the type of paper used for the labels, the operation of the thermal printer can essentially be automated because the type of paper for the labels need no longer be input manually by the operator, but the processor 104, by means of the paper sensor 120, can automatically identify which type of labels have been inserted. On the basis of the data received in this manner, the processor 104 retrieves the corresponding data matrix from the second memory area 127 of the read/write memory 125, and the ink ribbon data specified for the type of paper identified from the fourth memory area 129. Using these data, the thermal printer can be controlled by the processor 104 as described above.

Figure 9:
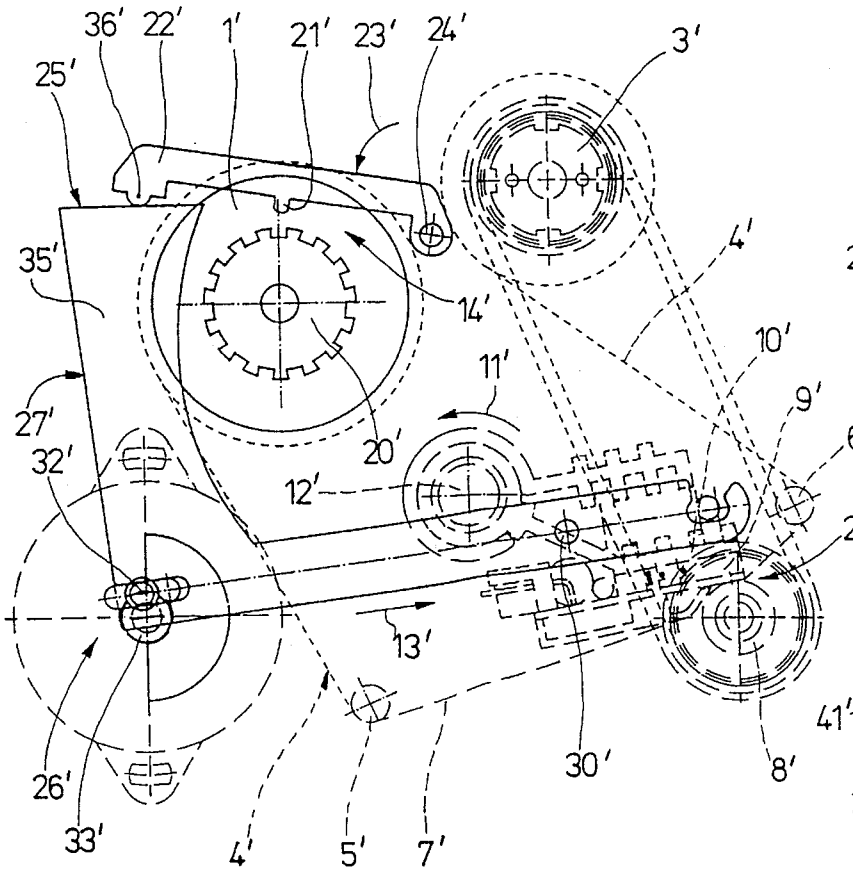
FIG. 9 is a side view of a portion of a thermal transfer printer in the vicinity of the thermal print head and the ribbon drive mechanism in the operating position.

FIG. 9 shows a printer in which the present invention could, in accordance with one embodiment, be utilized. It should be understood that the components and methods discussed above with regard to FIGS. 1–8, if appropriate, essentially be considered to be interchangeable with similar components discussed further herebelow with relation to FIGS. 9–24. Further, the example of a printer shown in FIGS. 8–11 is presented essentially only by way of example to illustrate one type of printer in which the present invention could be utilized.

As shown in FIG. 9, a printer for printing labels can generally have a printing area 2'. One such type of printer can include a thermal transfer printer, such as that described with reference to FIG. 8. In a printer, or thermal transfer printer, an ink ribbon, or thermal transfer ribbon 4' can be unwound from a first spool 1', can be guided through the printing area 2', and can then be wound up on a second spool 3', which could alternately be termed a "take-up spool". The two spools 1' and 3', are preferably located in an ink ribbon cassette, discussed in more detail herebelow with reference to FIGS. 12–24. In addition to the spools 1' and 3', guide rollers 5' and 6' can also preferably be a part of the ink ribbon cassette.

A portion of the thermal transfer ribbon 4' which extends between the guide rollers 5' and 6' can essentially be termed an active strand 7' of the ribbon 4'. In the depicted embodiment, this active strand 7' is preferably guided by means of a counterpressure roller 8' on the printer. Between the thermal transfer ribbon 4' and the counterpressure roller 8', a medium to be printed can preferably be guided. Such a printing medium, which is depicted in more detail in FIGS. 8 and 12, can, for example, include a backing strip which carries labels to be printed. During printing, a thermal print head 9' would typically be disposed in contact with the moving, working strand 7' of the thermal transfer ribbon 4' and, with the interposition of the above-mentioned medium to be printed, presses the thermal transfer ribbon 4' and printing medium firmly against the counterpressure roller 8'.

Figure 11:
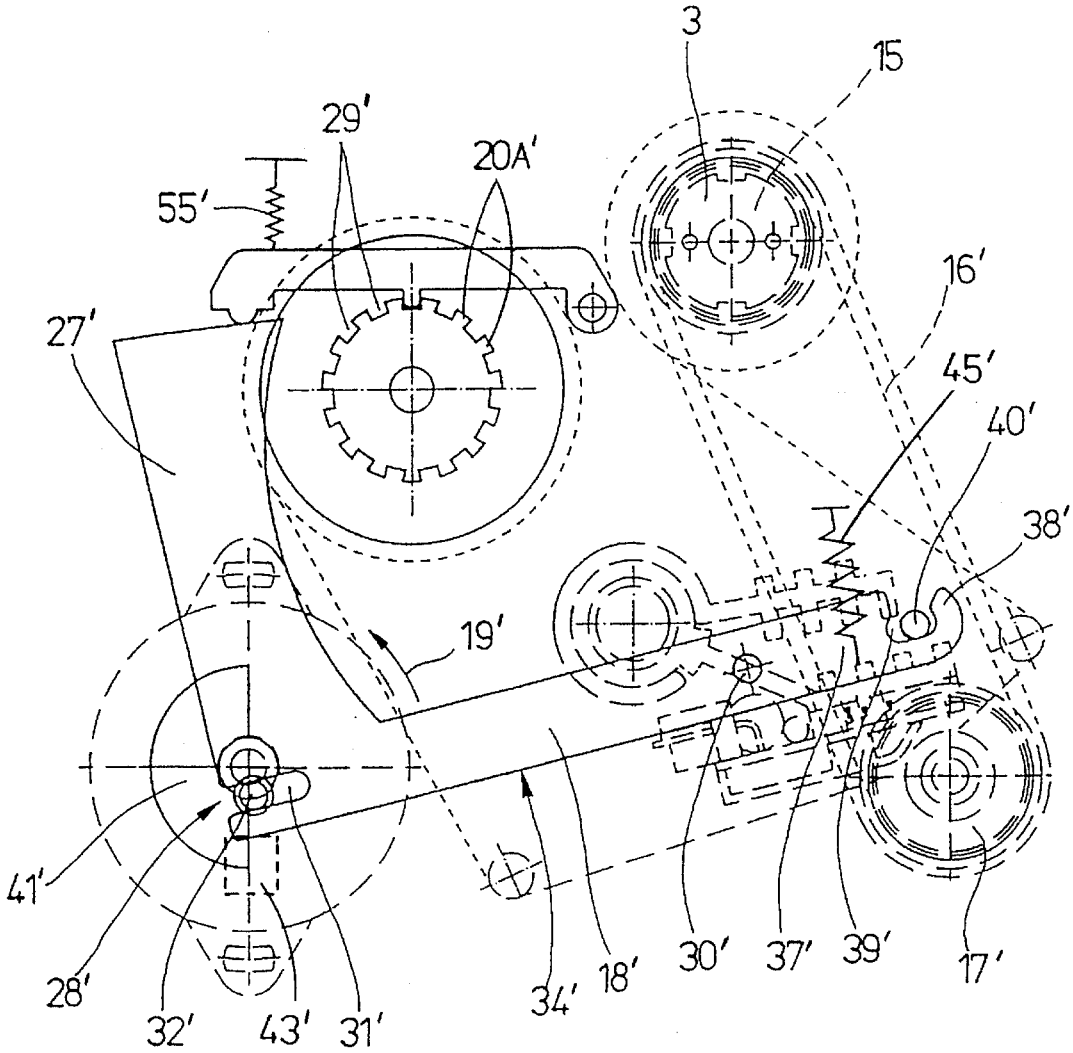
FIG. 11 shows a more detailed representation of the printer as depicted in FIG. 10.

The application force for pressing the thermal transfer ribbon 4' and printing medium firmly against the counterpressure roller 8' can be applied by a biasing device, such as, for example, a coil compression spring 45', which is shown in FIG. 11. This coil compression spring 45' preferably pushes on a pivoting arm 10'. The pivoting arm 10' can preferably support the thermal print head 9'. The above-mentioned arm 10', which can be pushed down by the coil compression spring 45', can pivot around the axis 12' in the direction indicated by the double arrow 11'.

The medium to be printed (107 in FIG. 8) can also be unwound from a roll or spool (108 in FIG. 8) and can be wound up, if necessary, on another roll or spool (108A in FIG. 8). The medium to be printed can typically be divided into individual fields to be printed, or the medium can also contain labels, for example, which do not need to be printed all the way to their front and rear edges. To this extent, therefore, there can typically be spaces which remain unprinted between succeeding, identical printed segments in the direction of transport 13' of the ribbon and of the median being printed.

In the unprinted sections of the medium being printed, that is, when no printing is being done, a continual advancement of the thermal transfer ribbon 4' would represent an unjustified expense. In other words, with a continual advancement of the thermal transfer ribbon 4' during periods when no printing is being performed, there would typically be portions of the thermal transfer ribbon 4' which would not have therefore been used, thus resulting in wasted ribbon 4'. The unnecessary consumption of the thermal transfer ribbon 4' can be reduced, or even possibly eliminated, by stopping advance of the thermal transfer ribbon 4' whenever the medium to be printed, which is in constant motion, does not need to be printed at a given point.

This comparatively sudden stopping of the thermal transfer ribbon 4' after printing the "last line" can preferably be accomplished by means of a stopping device 14'. In general, to print in a thermal transfer process, the printer basically requires a corresponding electronic control system with a computer. Because such a control system would essentially already have access to all the necessary data regarding the stopping and starting of printing, the existing control system can preferably also be used to control the stopping device 14'. In other words, the existing control system could preferably be used to move the stopping device 14' into the operating position when the thermal transfer ribbon 4' need not advance, and to release the stopping device 14' once again when the medium to be printed has advanced to the point where the next area to be printed has arrived in the printing area 2'.

The stopping device 14' can preferably also operate in conjunction with a slip clutch 15', (see FIG. 10) which is not illustrated or explained in any further detail herein, as slip clutches are generally well known. In the illustrated embodiment of FIG. 10, the driving side of the slip clutch 15' is driven by means of an endless drive element 16', e.g. a toothed belt, and by an electric motor 17'. Because of the presence of the slip clutch, during a printing job, the electric motor 17' can essentially always remain turned on, so that the driving side of the slip clutch 15' is in constant rotation. The slip clutch 15' transmits the torque from its driving side to its driven side, on which the second spool 3' would generally be located. If the stopping device 14', however, or some other cause, such as jamming, were to abruptly interrupt the movement of the ribbon 4', the friction moment of the slip clutch 15' would essentially no longer suffice to transmit the driving force of the electric motor 17' to the driven side of the slip clutch 15', and the slip clutch 15' would consequently slip. Then, as soon as the stopping device 14', once again releases the first spool 1', the driven side of the slip clutch 15' could also move, and consequently the thermal transfer ribbon 4', unwound from the first spool 1', could be wound up again on the second spool 3'.

For various reasons, one of which is to at least prevent a tearing of the thermal transfer ribbon 4' when it is stationary, during these stationary phases, the application pressure with which the thermal print head 9' is pressed against the counterpressure roller 8' should also preferably be overcome. This can be done in a simple manner, e.g. by pivoting an actuation element 18' (see FIG. 10) at the appropriate time, in the direction indicated by the arrow 19', under the control of the printer control system. The actuation element 18' can be connected in a manner not shown in any further detail to the pivoting arm 10', and consequently can drive the arm 10' in the same direction of rotation, whereupon the thermal print head 9' can be raised from the counterpressure roller 8'.

In purely theoretical terms, of course, the counterpressure roller 8' could also be lowered away from the print head 9', but the first alternative is preferable for a variety of reasons. As discussed earlier, since the print head 9' can preferably be biased towards the counterpressure roller 8', a movement of the print head 9' against the biasing force would immediately neutralize the biasing force, while a movement of the counterpressure roller 8' away from the print head 9' would only gradually decrease the application force over a distance. On the other hand, if the counterpressure roller 8' was being biased into engagement with the print head 9', a preferred movement of the counterpressure roller 8' might be desirable.

To provide a locking device in accordance with the present invention, the first spool 1' can preferably be non-rotationally connected to an externally-toothed wheel 20'. Above the wheel 20' in the plane of the depicted embodiment, a locking tooth 21' can be provided for engaging with the teeth 20A' (see FIG. 11) of the toothed wheel 20'. The locking tooth 21' can be held by e pivoting arm 22' and can preferably be manufactured as one piece with the pivoting arm 22'. The pivoting arm 22' can preferably be pivoted around an axis 24' in the direction indicated by the double arrow 23', or that is, towards and away from the toothed wheel 20'. During printing, the pivoting arm 22' would typically be in the angular position indicated in FIG. 9, that is, an unengaged position with respect to the toothed wheel 20'. The arm 22' can preferably be retained in this inactive position by means of a holding device, such as a regulatable locking element 25'. By means of a drive mechanism 26' which can preferably be controlled by the control system of the printer, the pivoting arm 22' can be moved into the active position shown in FIG. 10.

In the illustrated embodiment, this movement takes place indirectly, i.e. the locking element 25' is located on a lever 27', which lever 27' is preferably mounted so that it can pivot, and which lever 27' can be adjusted by means of a cam drive mechanism 28' (see FIG. 10), which cam drive mechanism 28' can be moved by the drive mechanism 26'. The lever 27' is preferably an angular lever having legs 34' (shown in FIG. 10) and 35' (shown in FIG. 9). The upper end of leg 35', in the drawing, preferably forms the locking element 25'. As soon as this upper end is lowered, the pivoting arm 22' follows this movement, and the locking tooth 21' can thereby be engaged in the next tooth space 29', as shown in FIG. 10. The pivoting arm can preferably follow the downward movement of the lever 27' due to gravity, however, if alternative positioning of the printing arrangement is desired, a biasing device 55' (see FIG. 11) could preferably be provided to bias the arm 22' towards the toothed wheel 20'.

The lever 27' can rotate around an axis 30'. In the vicinity of the angle corner of the lever 27', that is, in the vicinity of the drive 26', there can preferably be en open-edged slot 31' (see FIG. 10) in which a pin 32' can be engaged. Both the slot 31' and the pin 32' are components of the cam drive mechanism 28'. The pin 32' can preferably be attached to a drivable rotational element 33'. This rotational element 33', in accordance with one embodiment of the present invention, can preferably execute only approximately one-half of a revolution to move the pin 32' through an arc of about 180 degrees, and thereby move the lever 27'. Thus, in accordance with the depicted embodiment, to lower the lever 27' from the position shown in FIG. 9 to the position shown in FIG. 10, the rotational element 33' can be rotated 180 degrees in a first direction which could be either a clockwise or counterclockwise direction. Then to move the lever 27' beck into its raised position, the rotational element 33' could be moved in a reverse direction 180 degrees. Alternatively, a raising movement could be brought about by a further 180 degree movement in the first direction. Thus, a reversing motor could be used as the drive 26' to provide a clockwise-counterclockwise movement as discussed above. Alternatively, a one-directional motor could be used as the drive 26' to provide only one of: a clockwise movement, or a counterclockwise movement, that is, provided that the slot 31' could accommodate the pin 32' throughout the full circumferential motion of the pin 32'.

Figure 10:
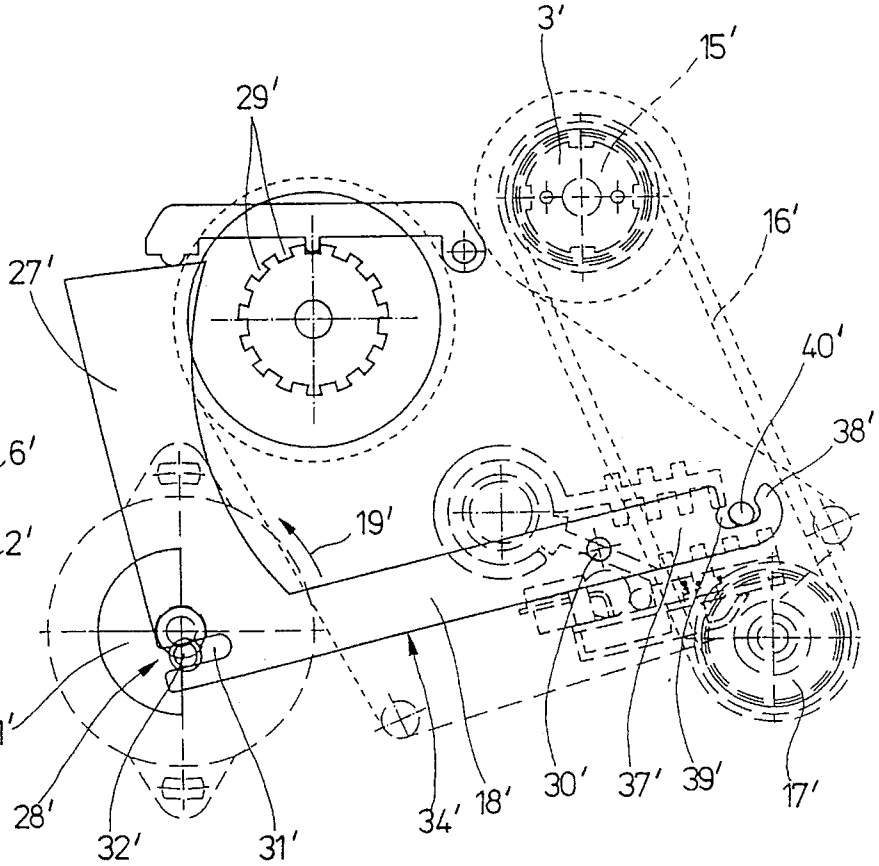
FIG. 10 is a comparable representation showing a released thermal transfer ribbon.

The slot 31', as shown in FIG. 10 for example, can preferably extend approximately in the longitudinal direction of the leg 34' of the angular lever 27' hinged to the axis 30'. Consequently, the locking element 25' can preferably be located on the free leg 35' (see FIG. 9). The pivoting arm 22', with the locking tooth 21', as shown in the illustrated embodiment, can preferably be a simple pivoting lever which has a projection, such as a preferably convex support element 36', on its free end This support element 36' can preferably be in contact on top with the end surface of the free leg 35' which forms the locking element 25'.

As shown in FIG. 10, the hinged leg 34' of the pivoting angular lever 27' can preferably extend beyond the axis 30'. The extending arm which is thereby formed is designated by 37'. This arm 37' can preferably be hook-shaped on its free end, and the hook 38' can essentially be formed by a slot 39' which can be open on the side A bolt 40', which can be fastened to the pivoting arm 10' can be engaged in this slot 39'. The pivoting arm 10' can in turn preferably be engaged to the print head 9' in a suitable manner. It could also be conceivable that a direct connection between the print head 9' and the end 37' of the lever 27' could be provided.

When the rotational element 33' with the pin 32', starting from its angular position illustrated in FIG. 9, is rotated by approximately 180 degrees, e.g. in a counterclockwise direction, the pin 32', which is engaged in the slot 31', can pivot the lever 27' also in the counterclockwise direction around its axis of rotation 30'. As a result, on one hand by means of the connection 39', 40', the thermal print head 9' can be raised from the counterpressure roller 8' and the pressure on the medium to be printed and the thermal transfer ribbon 4' in the printing area 2' can be neutralized. In addition, the locking element 25' can be lowered, whereupon the pivoting arm 22' can execute a pivoting motion in the direction indicated by the arrow 23'. Thus, while the pressure is being released there can be an essentially simultaneous engagement of the locking tooth 21' in a next available tooth space 29', as shown in FIG. 10. The stopping of the thermal printing ribbon 4' is therefore basically accompanied by the elimination of the pressure on the print heed 9' in the printing area 2'.

The control for the 180 degree rotational movement of rotational element 33' can preferably be achieved by means of a control cam 41', which can preferably be non-rotationally connected to the rotational element 33', and a sensor 43' (see FIG. 11), e.g. a sensor which could possibly operate on an optical principle, which can preferably sense the two radial edges of the control cam 41'. In this area, therefore, there is a corresponding control unit for the drive motor 26' of the rotational element 33'. In other words, a sensor can preferably be provided for indicating when the cam 41' has attained a 180 degree rotation to thereby stop movement of the cam 41' and the lever 27'.

Alternatively, instead of the cam 41' and drive 26', a solenoid switch could possibly also be used in another possible embodiment of the present invention, to move the lever 27'. As such, a switching of the solenoid between an on and off position could be used to move the lever 27' between the two positions as illustrated in FIGS. 9 and 10. Such solenoid switches are generally well known and are not discussed in any further detail herein.

Figure 12:
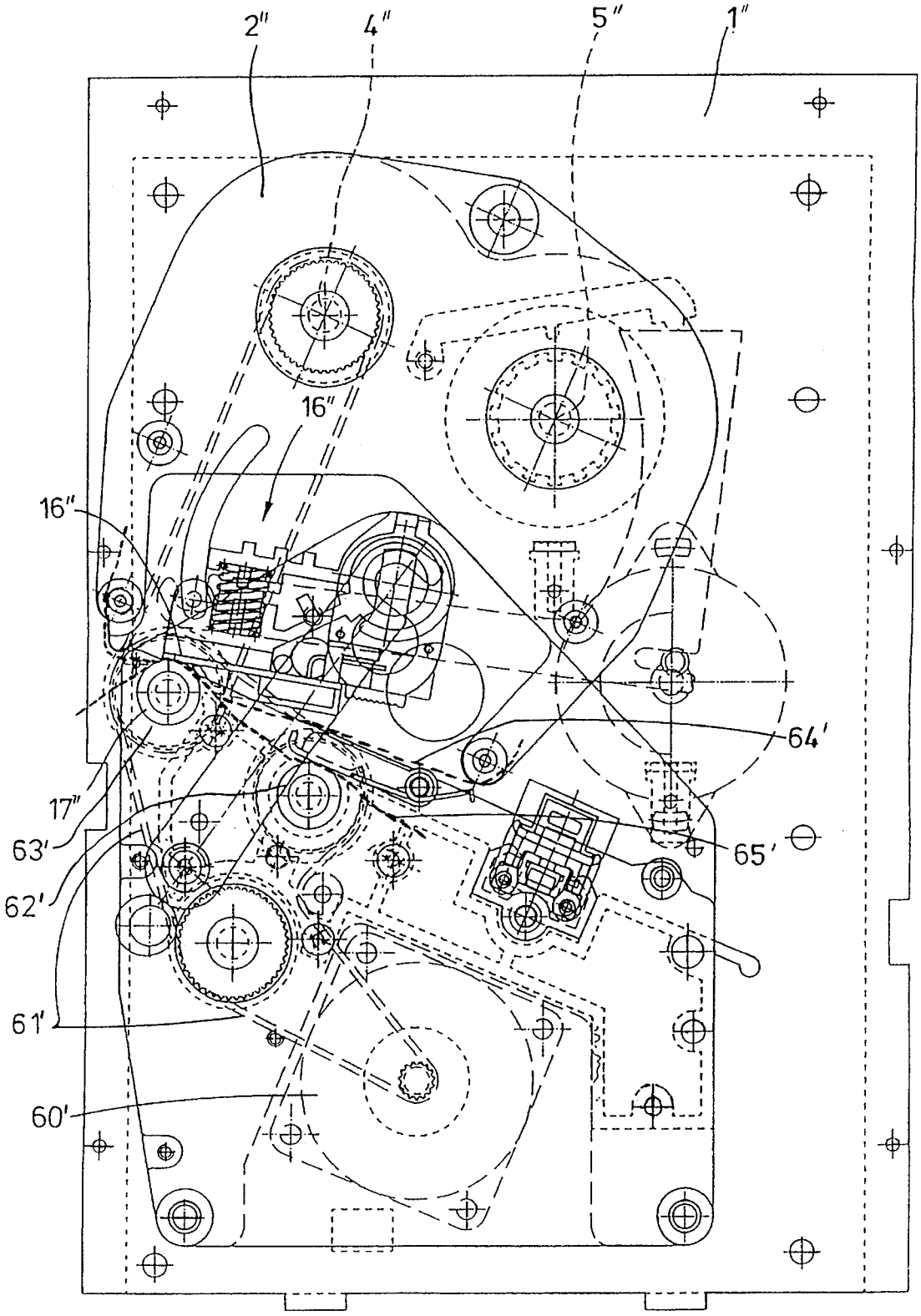
FIG. 12 is a side view of one embodiment of a printer with an inserted cassette.

As depicted in FIG. 12, a drive motor 60' could be provided for feeding the printing ribbon 64' and the label material 65' through the area adjacent the print head 16". In essence, the counter pressure roller 17", could be provided to move the label material 65' and printing ribbon 64' past the print head 16" when the counterpressure roller 17" is engaged with the print head 16". However, when the print head 16" is disengaged from the counterpressure roller 17", there would be essentially no further movement of print ribbon 64' or label material 65', and thus, the further roller 62' is also provided to enable a continuous feed of the label material 65'. A drive belt 61' could preferably be provided to drive the rollers 17" and 62' by means of pulley devices 63' which can be non-rotatably connected to the rollers 17" and 62'.

One type of cassette 111 for use in a printer such as the printer of FIG. 8 is depicted in greater detail with reference to FIGS. 12–24. In the printer depicted in FIG. 12, which essentially depicts the stopping arrangement as described earlier in FIGS. 9 and 10, in reverse image, a cassette 2" can be inserted into the printer 1" approximately perpendicular to the plane of the drawing. A rear wall 3" (see FIG. 17) of the printer 1" can preferably be penetrated by two externally-toothed shafts located at a lateral distance from one another, whereby for example the one shaft 4" can be connected to a drive motor, while the other shaft 5" can be a brake shaft connected to a slip clutch, as discussed previously. The lateral distance 6" (see FIG. 13) between the two shafts 4" and 5" can preferably correspond to the distance between the holes of the cassette 2", or the distance between the shafts 4" and 5".

Figure 13:
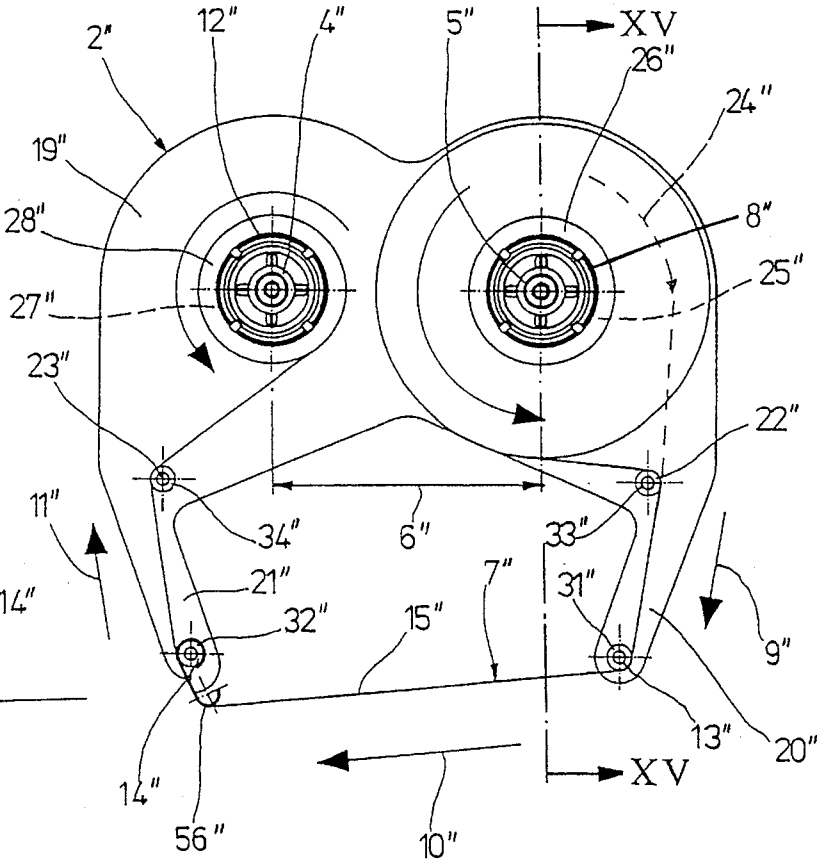
FIG. 13 is a plan view of a cassette.
Figure 14:
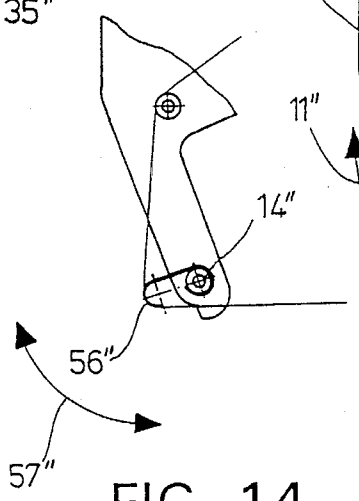
FIG. 14 is a detail if FIG. 13, with the guide plate in another position.
Figure 15:
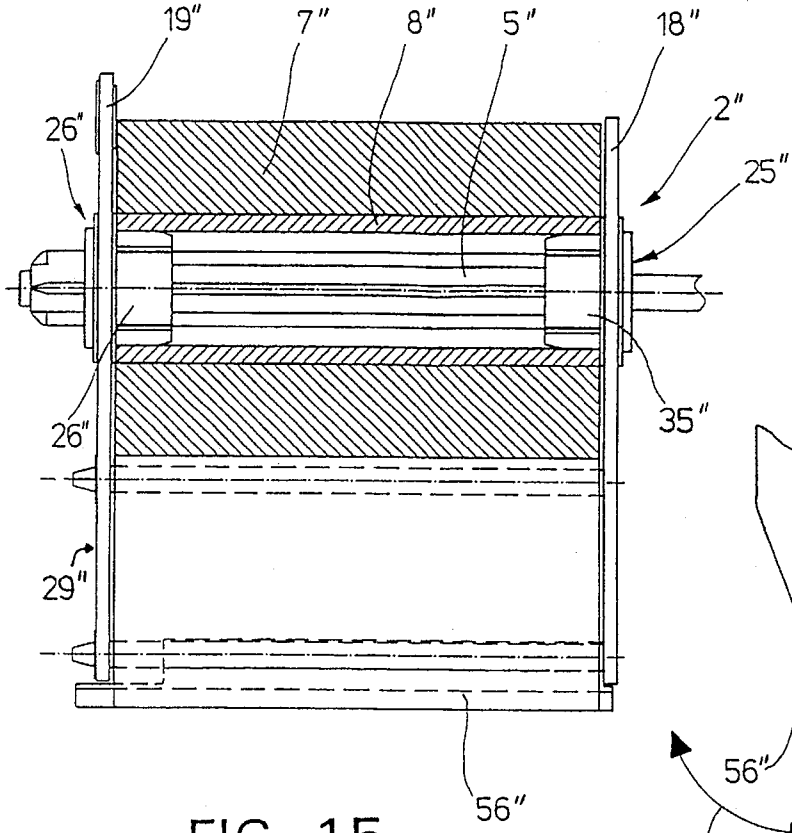
FIG. 15 is a cross section taken along line XV—XV in FIG. 13.

As shown in FIGS. 13 and 15, the cassette 2" holds a tape 7" which can preferably be on a core 8" preferably a core made of cardboard, while other materials are usable as well. When this tape 7" is to be paid out in the direction indicated by the arrows 9", 10" and 11" in FIG. 13, the tape 7" and the core 8" are first assigned to the brake shaft 5". When the drive shaft 4" is driven, the ribbon 7" can be unwound from the core 8" and wound up on another core 12", which core 12" can preferably be penetrated by the drive shaft 4". The ribbon 7" can also be deflected by means of deflectors 13" and 14" on the lower end of the cassette in FIG. 13. The segment of the ribbon 7" located between these deflector elements 13" and 14" can form the working, usable strand 15" of the ribbon 7". This working strand 15" can preferably be guided between a printing head 16" of the printer 1" and a printing, or counterpressure, roller 17" (FIG. 12).

The essential components of the cassette 2" can essentially be two parallel housing halves 18" and 19" as shown in FIG. 15. The housing halves 18" and 19" can essentially be C-shaped, as shown in FIG. 13, so that cassette arms 20" and 21" are formed The two deflector elements 13" and 14" which can be pins, pointed on the free end thereof, as illustrated in FIG. 18, for example, can preferably be attached to the free ends of the arms.

Approximately at the transition to each arm 20" and 21", there can preferably be respective additional deflector elements 22" and 23" for the ribbon 7". Also as illustrated in FIG. 18, these additional deflector elements 22" and 23" can preferably be pointed pins which can be fastened to the housing half 18' by means of a screw 23" i.e. preferably to the housing half which corresponds to the rear wall 3". The ribbon 7" can either be unwound as shown by the solid line in FIG. 13, or, alternatively, can be unwound as shown by the dotted line 24" in FIG. 13. As such, the cassette 2" can be used both for an externally-wound ribbon or tape 7" and for an internally wound ribbon.

Additional important elements of the cassette 2" include at least one core on each shaft 4" and 5", respectively. But in all the embodiments, instead of one long core on each shaft 4" and 5", there can alternatively be, two short, coaxial cores 25" and 26" or 27" and 28" respectively, as shown in FIGS. 13 and 15. Each pair of cores 25", 26" and 27", 28" can hold the ends of a tape core 8" or 12" respectively. The cores 25" and 27" can be mounted so that they can rotate in the first housing half 18", and the cores 26" and 28" so that they can rotate in the second housing half 19". Each core 25" to 28" can be designed in two parts as illustrated in FIG. 18, for example, which facilitates the installation of the cores in the housing 29". This housing 29", as described above, can be formed from the two housing halves 18" and 19" and the deflector elements 13", 14", 22" and 23", preferably formed by pins.

Figure 16:
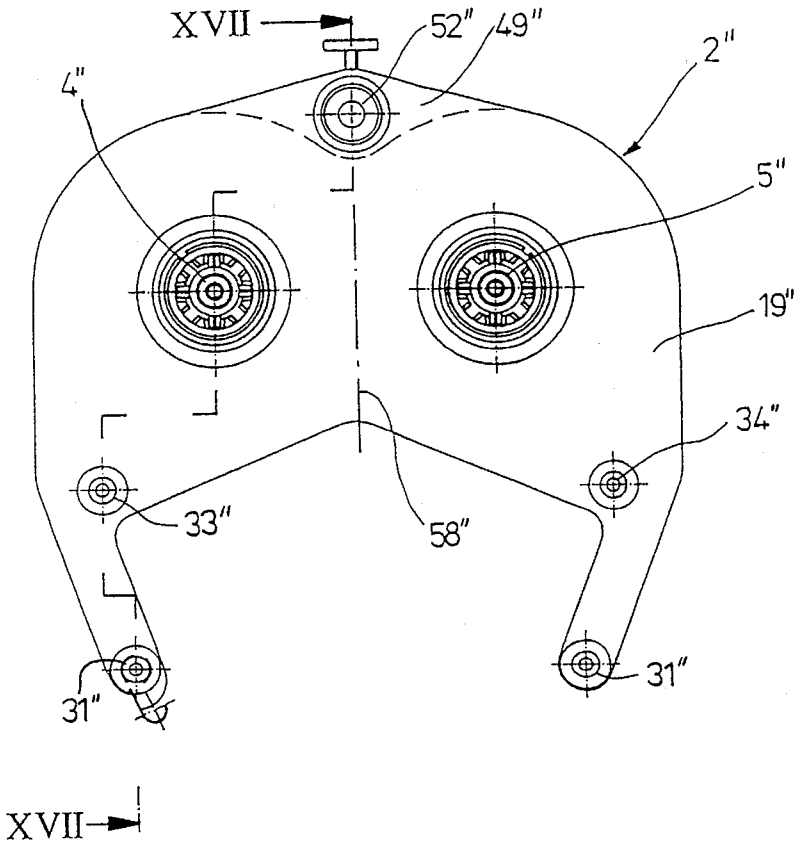
FIG. 16 is a plan view of the cassette illustrated in FIG. 12.
Figure 18:
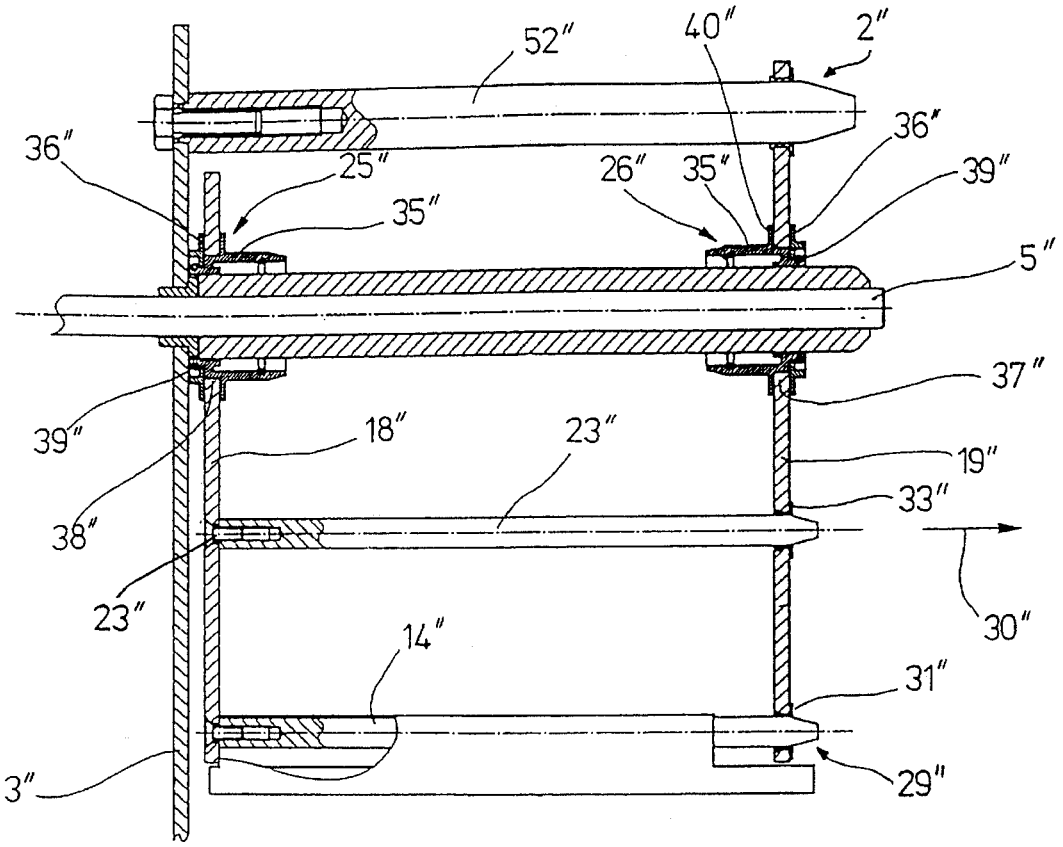
FIG. 18 is a cross section through the cassette illustrated in FIG. 13, whereby the cross section is essentially the same as the cross-section illustrated in FIG. 16.

The housing half 19" can be pulled off the pins 13", 14", 22" and 23" (shown in FIG. 13) in the direction of the arrow 30" (shown in FIG. 18}, and can preferably be held on the free ends of the pins essentially only by clamping. The deflector elements 13", 14", 22" and 23" can provide for a correct positioning of the housing half 19", and can each be preferably held by a bushing, preferably a plastic bushing 31", 32", 33" and 34" as shown in FIGS. 13 and 16, in each opening of the second housing half 19".

In an alternative embodiment of the apparatus, the bushings 31"–34" could be optional if the surfaces of the pins 13", 14" 22" and 23" or of the adjoining orifices through which the pins pass, had a surface treatment which performed in the same manner as the bushing 31"–34". For example, a plastic, or possible teflon coating could be applied to form a wear layer with an appropriate friction coefficient that facilitated movement of the housing halves 18" and 19" along the pins 13", 14" 22" and 23".

Figure 20:
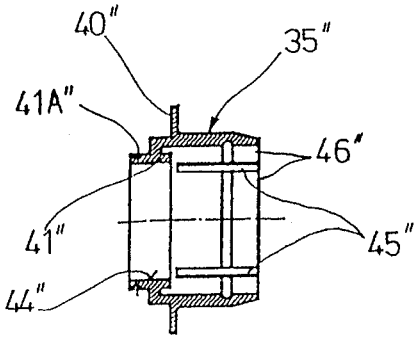
FIG. 20 is a longitudinal center section through the base body of FIG. 19.
Figure 23:
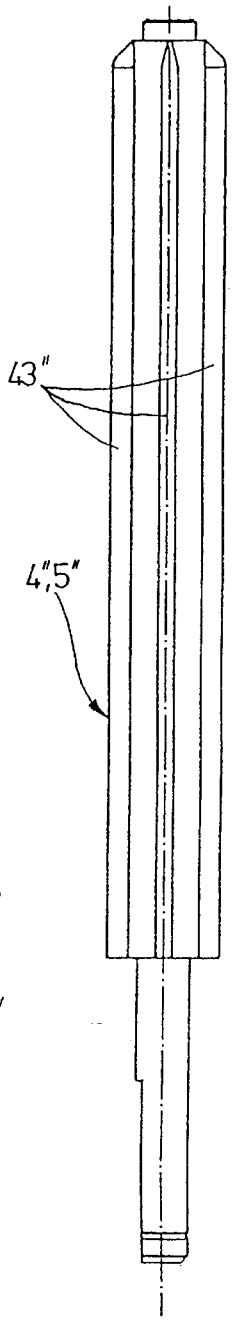
FIG. 23 is a plan view of the drive shaft corresponding to the cores.
Figure 22:
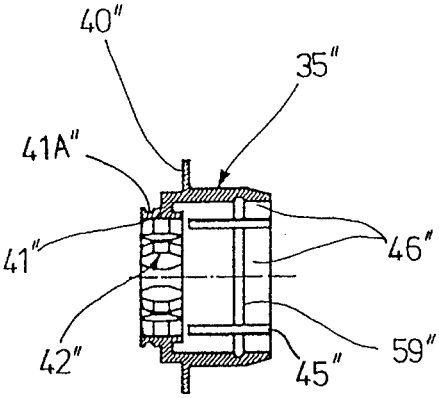
FIG. 22 is a longitudinal center section through the base body illustrated in FIG. 21.

As shown in FIG. 18, for example, all the cores 25" to 28" can be designed in two pieces, and each of them can be formed by a sleeve-shaped base part 35" and a ring-shaped retaining part 36" which can be connected to the cores. The sleeve-shaped base parts 35" can be inserted in corresponding holes 37" and 38" in the housing halves 19" and 18" respectively. The ring-shaped retaining part 36" can be inserted onto the projecting end, and can be axially secured by means of a retaining element 39", preferably a retaining ring, which retaining element 39" could preferably snap into a groove 41A" as shown in FIGS. 20 and 22. Each sleeve-shaped base element 35" can be in contact by means of an external shoulder 40" (see FIGS. 20 and 22) against the inside surface of the corresponding housing half 18" or 19" respectively. Opposite, on the outside of each housing half 18" or 19", the ring-shaped retaining part 36" can preferably axially secure each base element to the housing half 18" or 19" respectively.

Figure 19:
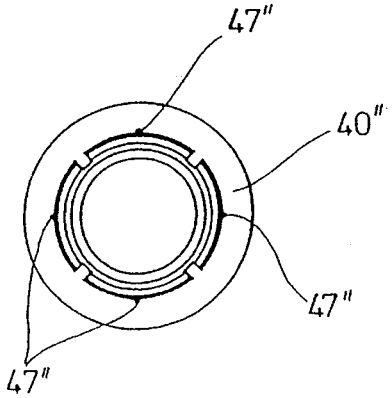
FIG. 19 is a plan view on en enlarged scale of the base of one of the two cores.

FIGS. 20 and 22 show in particular that the base pert 35" becomes smaller in a stepped fashion, whereby the ring-shaped retaining part 36" can be pressed onto the smaller sleeve-shaped partial piece 41" as shown in FIG. 18, and the retaining element 39" can be locked to the retaining element 36" via notch 41A". This partial piece 41" can be elongated into the inside of the core, as shown in FIGS. 20 and 22. In any case, on the smaller, sleeve-shaped partial piece 41" of the first cores 26" and 28", there can be internal teeth 42" (see FIGS. 21 and 22) which can correspond to the external teeth 43" on the shafts 4" and 5" respectively, see FIGS. 23 and 24. Such internal teeth could also be provided on all the sleeve-shaped base parts 35", but the embodiments specify that the sleeve-shaped base parts 35" of the second cores 25" and 27" have a hole 44" with a preferably smooth inner surface, as shown in FIGS. 19 and 20. The free ends of the teeth 43' of the shafts 4" and 5" can then be in contact with this smooth inner surface.

Figure 21:
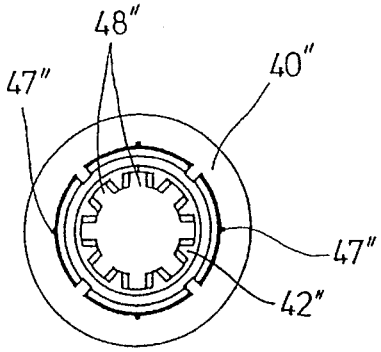
FIG. 21 is a plan view of the other base body of the cores.
Figure 24:
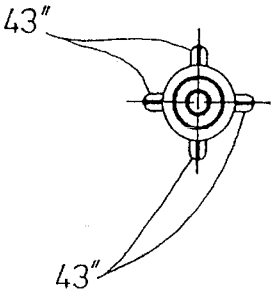
FIG. 24 is a plan view of the drive shaft illustrated in FIG. 23, from the right.

FIGS. 20 and 22 also show that the sleeve-shaped base parts 35" can be provided in the vicinity of their larger diameter with slots 45" thereby forming flexible tabs 46". FIGS. 11 and 13 show that the flexible tabs 46", of FIGS. 20 and 22, can each have a radially projecting retaining element 47" on the outside, preferably in the form of a small radial strip. This can improve the frictional and interlocking connection between the cores 25" to 28" and the tape cores 8" and 12" respectively. To maintain the clamping action between the tabs 46" and the tape cores 8" and 12", the tabs 46" can be permanently pushed radially outward by a retaining ring (not shown) which can be inserted in an internal groove 59". As shown in FIGS. 21 and 24, there can be a larger number, e.g. twice the number of locator grooves 48" than the number of teeth 43" i.e. eight grooves 48" as compared to only four teeth 43".

Figure 17:
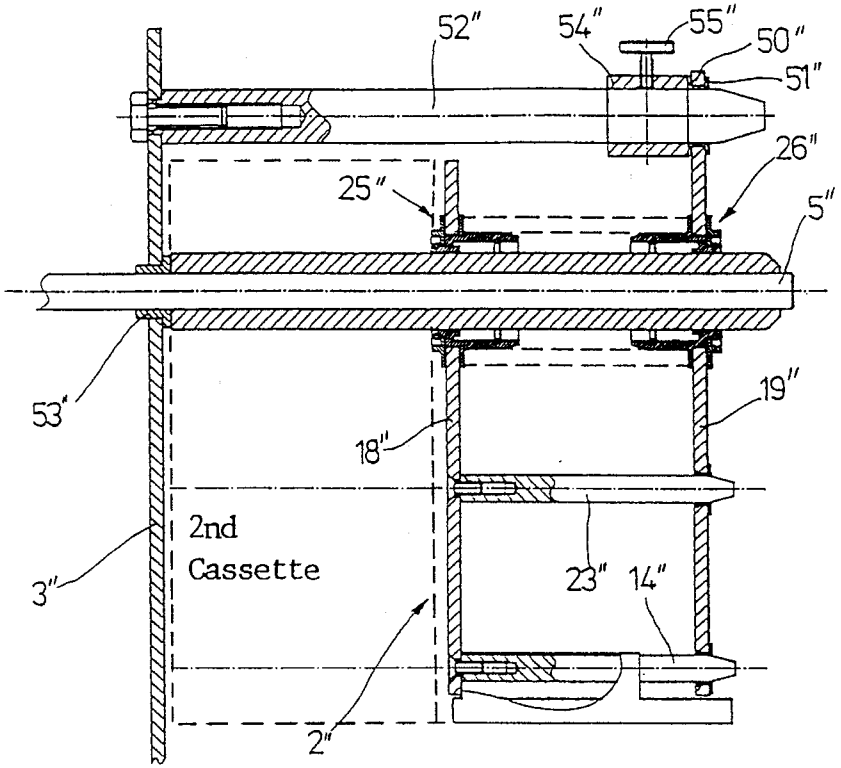
FIG. 17 is a cross section taken along line XVII—XVII in FIG. 16.

The cassette 2" illustrated in FIG. 18 is intended for relatively wide tapes 7". But it is also possible to install narrower tapes 7" in this cassette 2", because the second housing half 19" can be mounted so that it can move on the pin-like deflector elements 13", 14", 22" and 23" and can be held in each position by friction. But if the second housing half 19", starting from its position in FIG. 18, is moved to the left toward the first housing half 18", the free ends of the pins on the right project beyond the housing half 19". If this is unacceptable for any reason, or at least if it is undesirable, shorter pins can be used instead. A change-over from long pins to short pins can essentially be performed very easily, because the pins are simply screwed or bolted onto the first housing half 18". FIG. 17 shows one embodiment with short pins or deflector elements 13", 14", 22", 23".

Otherwise, however, this embodiment of FIG. 17, is designed similarly to the cassette 2" illustrated in FIG. 18, with essentially only one slight difference, namely that the shape of the housing half 19" of FIG. 17, on its upper end, differs from the shape of the cassette illustrated in FIG. 13. In the embodiment of FIG. 17, the housing half 19" can be provided on its upper end with a bulge 49" (see FIGS. 16 and 17) in which there is a passage 50". In the latter case, a bearing bushing 51", preferably made of plastic, is inserted. When this cassette is inserted into the printer 1", a locator pin 52" located on the rear wall 3" of the printer 1" can engaged in the hole of the bearing bushing 51". The cassette 2" illustrated in FIGS. 16 and 17 can be securely fixed in the printer 1" by means of this locator pin 52" and the two shafts 4" and 5". To facilitate the insertion of the cassette the free end of the locator pin 52" can preferably be somewhat pointed. As shown in the accompanying figures, the same can be true of the shafts 4" and 5". The shafts 4" and 5" can also each run through a bearing bush 53" in the wall 3". The bearing bush 53" in the wall 3" is preferably used for the axial and radial support of the shafts.

Because the cassette 2" illustrated in FIG. 17 is narrower than the cassette 2" in FIG. 18, the thickness of which equals approximately the length of the shafts 4" and 5", to the extent that the shafts 4" and 5" project beyond the well 3", the precise position of the cassette 2" with respect to the printer 1" or its wall 3" must be specified by suitable means. One possibility is to place a sliding collar 54" with a set screw 55" over the locator pin 2". It is easy to see that by pushing the sliding collar 54" toward the left, i.e. toward the wall 3", the stop formed by the sliding collar can be moved, and thus the cassette 2" can be moved back closer to the wall 3". On the other hand, as shown in FIG. 17, it could also be possible to install two cassettes 2" (one of which is shown only schematically) next to one another in the printer 1", whereby each cassette can be loaded with an individual printing ribbon, e.g. with ribbons of different colors.

It is also possible first to print any labels or similar material with the cassette 2" in the position illustrated in FIG. 9, and then to push the cassette 2" all the way to the left, to then apply a second impression next to the first impression on the material being printed.

In the vicinity of at least one of the deflector elements 13", 14" in the embodiment illustrated in FIG. 13, on the deflector element 14", there can preferably be a guide plate 56" which can be pivotably mounted on this deflector element 13" or 14", so that the guide plate 56" can pivot in the direction shown by the double arrow 57". The guide plate 56" can preferably be clamped in its respective pivot position. The working position of the guide plate 56" is shown in FIG. 13. The usable strand 15" can thereby be pulled out beyond the free end of the cassette arm 21". If, on the other hand, the guide plate 56" were to be moved into the angular position illustrated in FIG. 14, the strand 15" would not project downward beyond the free end of the housing 29", but if necessary, would project laterally beyond the outside of the cassette arm 21". But that is irrelevant when the cassette 2" is installed in the printer 1", in terms of a danger of damage to the ribbon. By pulling the left end of the usable strand 15" out of the cassette 2", as shown in FIG. 13, the printing roller 17" (shown in FIG. 12) could be wrapped over a somewhat greater angle, thereby increasing frictional engagement between the printing roller 17" and the strand 15", which would be advantageous for printing at a high ribbon speed.

Because the cassette 2" is symmetrical along a longitudinal center plane 58" (FIG. 16, it can be used as a reversible cassette, i.e. after the ribbon 7" has run all the way through, the cassette 2" can preferably be simply be turned over like known audio cassettes, end the ribbon 7" can be run through once again. For such reversibility, a guide plate 56" could preferably also be required on the cassette arm 20". Either a guide plate 56", as shown in FIGS. 13 and 15, can be attached to both cassette arms 20" and 21", or the guide plate 56" can be switched from one cassette arm to the other, so that it can be removed from the cassette arm 21" and pushed onto the cassette arm 20' after the cassette 2" has been turned over.

The cassettes 2" described above can be assembled and disassembled easily. In particular, the cassette 2" can inserted into the printer 1" easily as a result of the design of the shafts 4" and 5" and the corresponding cores 25" to 28" in a self-locating mechanism, whereby the ease of insertion can be further increased if there are twice the number of locator grooves 48".

In accordance with one conceivable embodiment of the present invention, the print head and the printing medium, as depicted in the figures described above, the print head could move relative to the printing medium, that is, the printing medium could remain stationary and the print head could move across the printing medium in order to transfer an image onto the printing medium. Alternatively, in accordance with another conceivable embodiment of the present invention, the printing medium could move relative to the print head, that is, the print head could remain stationary and the printing medium could move across the print head and receive the image from the print head.

One feature of the invention resides broadly in the printer 1 with a control panel 2, in which the housing 6 or similar structure has a panel receptacle 3 to hold the removable control panel 2, whereby the control panel is connected by means of a cable 9 or at least a wireless infrared transmitter to the control components of the printer 1, characterized by the fact that the control panel 2 is fixed in the panel receptacle 3 at least in the direction of removal by means of at least one magnet 10.

Another feature of the invention resides broadly in the printer with control panel characterized by the fact that there is at least one permanent magnet 10 located on the base 11 of the modular control panel 2.

Yet another feature of the invention resides broadly in the printer with control panel characterized by the fact that the panel receptacle 3 is made of a ferromagnetic material 12, at least in the vicinity of each magnet.

Still another feature of the invention resides broadly in the printer with control panel characterized by the fact that if the panel receptacle 3 is made of plastic or aluminum, a metal insert 12 made of a ferromagnetic material is embedded in the plastic or aluminum in the vicinity of each magnet 10 of the control panel 2.

A further feature of the invention resides broadly in the printer with control panel characterized by the fact that each permanent' magnet 10 is made of a magnetic film.

Another feature of the invention resides broadly in the printer with control panel characterized by the fact that the magnets 10 are mounted flush in the base 14 of the control panel 2 or project from the base 14 to form feet.

Yet another feature of the invention resides broadly in the printer with control panel characterized by the fact that the panel receptacle 3 has a box-like shape, whereby there is one fastening edge 21, 22 which extends at right angles from at least two opposite box walls 19, 20 and that there is a cable bushing 13 on the base of the box 11.

Still another feature of the invention resides broadly in the printer with control panel characterized by the fact that the control panel 2 has an essentially rectangular housing 24 with a circumferential edge which projects laterally on the control side, the outside dimensions of which housing approximately correspond to those of the opening of the cavity 17 of the panel receptacle 3.

A further feature of the invention resides broadly in the printer with a control panel characterized by the fact that a cable trough 25 extending over at least three sides is located on the outside of the base 14 of the control panel 2.

Another feature of the invention resides broadly in the printer with control panel characterized by the fact that there is at least one retaining tab 26 or similar device for the cable 9 which projects perpendicularly over each of the at least three segments of the cable trough 25.

Yet another feature of the invention resides broadly in the printer with control panel characterized by the fact that there is an opening partly in at least one of the side walls 15 and partly in the base 14 of the housing of the control panel 2 for the cable 9 for the transmission of data.

Types of thermal transfer printers which could be utilized in accordance with the present invention are disclosed in the following U.S. Pat. No. 5,305,020 to Gibbons et al. on Apr. 19, 1994, entitled "Thermal Transfer Printer Having Media Pre-coat Selection Apparatus and Methods"; U.S. Pat. No. 5,325,113 to Takeda on Jun. 28, 1994, entitled "Resistive Sheet Thermal Transfer Printer"; and U.S. Pat. No. 5,259,680 to Shimizu et al. on Nov. 9, 1993, entitled "Thermal Transfer Printer and Ink Sheet Cassette for Use in Same".

Types of thermal printers which could be utilized in accordance with the present invention are disclosed in the following U.S. Pat. No. 5,319,390 to Watanabe et al. on Jun. 7, 1994, entitled "Thermal Printer Apparatus"; U.S. Pat. No. 5,296,874 to Nagata et al. on Mar. 22, 1994, entitled "Thermal Printer"; and U.S. Pat. No. 5,321,426 to Back et al. on Jun. 14, 1994, entitled "Scan Laser Thermal Printer".

Types of magnetic films which could be utilized in accordance with the present invention are disclosed in the following U.S. Pat. No. 5,290,629 to Koiso on Mar. 1, 1994, entitled "Magnetic Film Having a Magnetic Phase with Crystallites of 200 A or Less and an Oxide Phase Present at the Grain Boundaries"; U.S. Pat. No. 5,265,073 to Osato on Nov. 23, 1993, entitled "Overwritable Magneto-optical Recording Medium Having Two-layer Magnetic Films Wherein One of the Films Contains One or More of Cu, Ag, Ti, Mn, B, Pt, Si, Ge, Cr and Al, and a Method of Recording on the Same"; and U.S. Pat. No. 5,231,294 to Takeuchi et al. on Jul. 27, 1993, entitled "Manganese-aluminum and Manganese-silicon Magnetic Films, and Magnetic Recording Medium".

Types of infrared transmitters and infrared receivers which could be utilized in accordance with the present invention are disclosed in the following U.S. Pat. No. 5,331,450 to Heap et al. on Jul. 19, 1994, entitled "Infrared Transmitter and Receiver and Method"; U.S. Pat. No. 4,371,814 to Mannas on Feb. 1, 1983, entitled "Infrared Transmitter and Control Circuit"; and U.S. Pat. No. 4,509,342 to Van-Antwerpen on Apr. 9, 1985, entitled "Infrared Receiver Having a Cooled Radiation Detector".

Types of radio transmitters which could be utilized in accordance with the present invention are disclosed in the following U.S. Pat. No. 5,252,965 to Gidwani et al. on Oct. 12, 1993, entitled "Changing One of Many Access Codes upon Removal of Ignition Key"; U.S. Pat. No. 5,199,108 to Self on Mar. 30, 1993, entitled "Short Range Radio Information System"; and U.S. Pat. No. 5,265,128 to Widmer et al. on Nov. 23, 1993, entitled "Method and Device for the Digital Transmission of Information in Short-wave Radio Networks".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 32 561.0, filed on Sep. 24, 1993, having inventor Dirk Umbach, and DE-OS P 43 32 561.0 and DE-PS P 43 32 561.0, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printer, such as a thermal printer for printing an image onto a printing medium, said printer comprising:

a housing;

means for printing an image onto a printing medium;

said printing means being disposed in said housing;

means for moving at least one of: the printing medium and said printing means relative to the other;

means for controlling said printer;

said housing comprising:

means for accepting said controlling means;

means for transferring information at least from one of a) and b):

a) said controlling means to said printer; and b) said printer to said controlling means;

means for selectively magnetically attaching said controlling means to said accepting means and selectively magnetically detaching said controlling means from said accepting means;

said means for magnetically attaching providing an attractive force between said controlling means and said accepting means, when said controlling means and said accepting means are attached to one another, such that a substantial manual force is required to separate said controlling means from said accepting means;

one of: said controlling means and said accepting means comprising said means for magnetically attaching;

the other one of: said controlling means and said accepting means having at least a portion comprising a magnetic material;

said controlling means comprising said means for magnetically attaching;

said means for magnetically attaching comprising at least one permanent magnet;

said controlling means further comprising a control panel;

said control panel comprises a base portion for being disposed towards said accepting means, said at least one permanent magnet being disposed at said base portion;

said at least a portion of said accepting means comprising a magnetic material is a first portion;

said accepting means comprising one of the following c), d) and e):

c) a second portion comprising a magnetic material and being disposed substantially adjacent said first portion;

d) a second portion comprising a plastic material and being disposed substantially adjacent said first portion; and e) a second portion comprising aluminum and being disposed substantially adjacent said first portion; and said at least one permanent magnet comprising a magnetic film.

2. The printer according to claim 1 wherein:

said base portion has two longitudinal sides and two transverse sides;

said two longitudinal sides of said base portion being disposed at a distance from one another and parallel to one another;

said two transverse sides of said base portion being disposed at a distance from one another and parallel to one another, said two transverse sides being disposed perpendicular to said two longitudinal sides of said base portion;

said control panel further comprises:

a front portion disposed opposite said base portion;

a length dimension defined between said two transverse sides of said base portion;

a width dimension defined between said two longitudinal sides of said base portion;

a side portion extending between said base portion and said front portion, said side portion being disposed substantially perpendicular to said base portion and said front portion; and an edge portion surrounding said base portion and extending away from said side portion in a direction substantially perpendicular to said side portion.

3. The printer according to claim 2 wherein:

said accepting means comprises a control receptacle;

said base portion of said control panel is a first base portion;

said control receptacle comprises:

a second base portion for being disposed towards said housing;

said second base portion having two longitudinal sides and two transverse sides;

said two longitudinal sides of said second base portion being disposed at a distance from one another and parallel to one another;

said two transverse sides of said second base portion being disposed at a distance from one another and parallel to one another, said two transverse sides of said second base portion being disposed perpendicular to said two longitudinal sides of said second base portion;

a first side portion and a second side portion disposed at a substantial distance from one another;

said first side portion extending from one of said two transverse sides of said second base portion in a direction substantially perpendicular to said second base portion;

said second side portion extending from the other one of said two transverse sides of said second base portion in a direction substantially perpendicular to said second base portion;

a length dimension defined between said first side portion and said second side portion;

a width dimension defined between said longitudinal sides of said second base portion;

said length dimension of said control panel is substantially similar to said length dimension of said control receptacle; and said width dimension of said control panel is substantially similar to said length dimension of said control receptacle.

4. A printer, such as a thermal printer, said printer comprising:

a removable control panel and a housing or similar structure, the housing or similar structure having a panel receptacle to hold the removable control panel;

the removable control panel being connected to the printer by means of one of a) and b):

a) a cable; and b) a wireless infrared transmitter;

at least one magnet;

the removable control panel being fixed in the panel receptacle, at least in the direction of removal, by means of the at least one magnet;

the removable control panel comprising a base;

the at least one magnet comprising at least one permanent magnet, the at least one permanent magnet being located on the base of the removable control panel;

the panel receptacle having at least a portion made of a ferromagnetic material, at least in the vicinity of each of the at least one permanent magnet;

the panel receptacle having an additional portion made of one of c) and d):

c) plastic; and d) aluminum;

the at least a portion made of a ferromagnetic material comprising a metal insert made of a ferromagnetic material, the metal insert being embedded in the additional portion comprising plastic or aluminum in the vicinity of each of the at least one permanent magnet of the removable control panel.

5. The printer as claimed in claim 4, wherein each of the at least one permanent magnet is made of a magnetic film.

6. The printer as claimed in claim 5, wherein:

the at least one permanent magnet comprises a plurality of permanent magnets;

the permanent magnets are mounted one of the following ways e) and f):

e) flush in the base of the removable control panel; and f) projecting from the base of the removable control panel to form feet.

7. The printer as claimed in claim 6, wherein:

the panel receptacle further comprises:

at least two opposite walls and a base located between the two opposite walls to form a box-like shape having an opening;

a fastening edge extending at right angles from each of the at least two opposite walls; and a cable bushing on the base of the panel receptacle.

8. The printer as claimed in claim 7, wherein:

the removable control panel further comprises:

an essentially rectangular housing, the housing comprising the base of the removable control panel;

the housing having a length dimension, a width dimension and a thickness dimension;

an edge which projects laterally from the base of the control panel;

the opening of the panel receptacle has a length dimension, a width dimension and a thickness dimension, the length, width and thickness dimensions of the housing approximately corresponding to those of the opening of the panel receptacle.

9. The printer with a control panel as claimed in claim 8, wherein:

the base of the removable control panel comprises:

four sides disposed substantially perpendicular to one another;

a cable trough having at least three segments extending along at least three sides of the base of the removable control panel;

at least one retaining tab or similar device for accommodating a cable for the transmission of data located in each of the at least three segments of the cable trough;

the housing of the removable control panel comprises an opening for permitting the cable to exit the removable control panel.

* * * * *

UNITED STATES PATENT AND TRADEMARK OFFICE

CERTIFICATE OF CORRECTION

PATENT NO. : 5,513,922

DATED : May 7, 1996

INVENTOR(S) : Dirk UMBACH

It is certified that error appears in the above-indentified patent and that said Letters Patent is hereby corrected as shown below:

In column 1, line 60, after 'least', delete "In" and insert --in--.

In column 2, line 17, after 'transmitter', delete "end" and insert --and--.

In column 2, line 47, after 'least', delete "pertly" and insert --partly--.

In column 3, line 20, after 'panel', delete "cables" and insert --cable--.

In column 4, line 2, after 'the', delete "date" and insert --data--.

In column 4, line 48, after 'printing', delete "en" and insert --an--.

In column 5, line 6, after 'for', delete "mowing" and insert --moving--.

In column 6, line 22, after 'on', delete "en" and insert --an--.

In column 8, line 31, after 'have', delete "e" and insert --a--.

In column 10, line 55, before 'memory', delete "reed/write" and insert --read/write--.

UNITED STATES PATENT AND TRADEMARK OFFICE

CERTIFICATE OF CORRECTION

PATENT NO. : 5,513,922

DATED : May 7, 1996

INVENTOR(S) : Dirk UMBACH

It is certified that error appears in the above-indentified patent and that said Letters Patent is hereby corrected as shown below:

In column 11, line 30, after 'temperature', delete "end" and insert --and--.

In column 11, line 34, after 'determined', delete "end" and insert --and--.

In column 16, line 13, after 'by', delete "e" and insert --a--.

In column 16, line 47, after 'be', delete "en" and insert --an--.

In column 17, line 44, after 'print', delete "heed" and insert --head--.

In column 19, line 19, after 'FIG.', delete "18}," and insert --18),--.

In column 19, line 53, after 'base', delete "pert" and insert --part--.

In column 20, line 45, after 'can' insert --be--.

In column 20, line 49, after 'cassette' insert --2'',--.

In column 20, line 59, after the second occurrence of 'the', delete "well" and insert --wall--.

UNITED STATES PATENT AND TRADEMARK OFFICE

CERTIFICATE OF CORRECTION

PATENT NO. : 5,513,922

DATED : May 7, 1996

INVENTOR(S) : Dirk UMBACH

It is certified that error appears in the above-indentified patent and that said Letters Patent is hereby corrected as shown below:

In column 21, line 37, after 'cassettes,', delete "end" and insert --and--.

In column 21, line 48, before 'inserted' insert --be--.

In column 22, line 20, before 'magnet', delete " permanent' " and insert --permanent--.

In column 23, line 18, after 'to', delete "Heap" and insert --Heep--.

In column 23, line 20, after 'to', delete "Mannas" and insert --Hannas--.

Signed and Sealed this

Fourth Day of February, 1997

*Attest:*

*Attesting Officer*

BRUCE LEHMAN

*Commissioner of Patents and Trademarks*